US008225770B2

(12) United States Patent
Ohta et al.

(10) Patent No.: US 8,225,770 B2
(45) Date of Patent: Jul. 24, 2012

(54) FUEL INJECTOR ASSEMBLY, CYLINDER HEAD SIDE MEMBER, AND FUEL INJECTOR INSTALLATION METHOD

(75) Inventors: Yasuki Ohta, Nagoya (JP); Tomohiko Iwase, Inazawa (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 390 days.

(21) Appl. No.: 12/705,082

(22) Filed: Feb. 12, 2010

(65) Prior Publication Data

US 2010/0242917 A1 Sep. 30, 2010

(30) Foreign Application Priority Data

Mar. 30, 2009 (JP) ..... 2009-083749

(51) Int. Cl.
*F02M 61/14* (2006.01)
*F02M 61/18* (2006.01)

(52) U.S. Cl. ..... 123/470; 239/533.13

(58) Field of Classification Search ..... 123/470, 123/193.5; 239/533.13; 277/313, 315
See application file for complete search history.

(56) References Cited

U.S. PATENT DOCUMENTS 4,392,655 A * 7/1983 Olsen et al. ..... 277/301
5,657,733 A * 8/1997 Dozier et al. ..... 123/470
6,807,945 B2 * 10/2004 Reiter et al. ..... 123/470
7,827,964 B2 * 11/2010 Chern et al. ..... 123/470
2003/0145832 A1 * 8/2003 Reiter et al. ..... 123/470
2003/0213472 A1 11/2003 Suzuki et al.
2004/0094129 A1 * 5/2004 Raimann ..... 123/470
2006/0065245 A1 * 3/2006 Kawamoto et al. ..... 123/470
2008/0245340 A1 * 10/2008 Beardmore ..... 123/470
2010/0175668 A1 * 7/2010 Chern et al. ..... 123/470
2011/0094478 A1 * 4/2011 Scheffel et al. ..... 123/470

FOREIGN PATENT DOCUMENTS

JP 2006-90282 A 4/2006

OTHER PUBLICATIONS

European Search Report dated Oct. 5, 2010 in the corresponding European Patent Application No. 10001733.4.

* cited by examiner

*Primary Examiner* — Mahmoud Gimie
(74) *Attorney, Agent, or Firm* — Global IP Counselors, LLP

(57) ABSTRACT

A fuel injector assembly includes a modular fuel injector unit and a cylinder head side member. The modular fuel injector unit includes a first fuel injector with a first seal, a second fuel injector with a second seal and a fuel distribution pipe coupled together as a single installable unit. The cylinder head side member includes a first insertion hole with a first fitting section and a second insertion hole with a second fitting section. The first and second insertion holes and the first and second seals of the first and second fuel injectors are arranged such that as the modular fuel injector unit is being mounted to the cylinder head side member, the first seal undergoes a maximum compressive deformation in the first fitting section at a time that does not coincide with a time that the second seal undergoes a maximum compressive deformation in the second fitting section.

17 Claims, 18 Drawing Sheets

FUEL INJECTOR ASSEMBLY, CYLINDER HEAD SIDE MEMBER, AND FUEL INJECTOR INSTALLATION METHOD

CROSS-REFERENCE TO RELATED APPLICATIONS

This application claims priority to Japanese Patent Application No. 2009-083749, filed on Mar. 30, 2009. The entire disclosure of Japanese Patent Application No. 2009-083749 is hereby incorporated herein by reference.

BACKGROUND

1. Field of the Invention

The present invention relates to a fuel injector assembly, a cylinder head side member, and a fuel injector installation method.

2. Background Information

An injector mounting structure is known (see Japanese Laid-Open Patent Publication No. 2006-90282) in which the injectors for injecting fuel into each of the cylinders of an engine and the fuel tubes for supplying fuel to the injectors are integrated into a single unit and the injector unit is mounted to a cylinder head main body by inserting the injectors into injector mounting holes formed in the cylinder head main body.

With this cylinder head apparatus, an O-ring is attached to a nozzle section of each of the injectors. The O-rings contact the injector mounting holes in an elastic fashion and prevent fuel from leaking out of the injector mounting holes.

SUMMARY

In the injector mounting structure disclosed in Japanese Laid-Open Patent Publication No. 2006-90282, the O-rings undergo compressive deformation when the injectors are inserted into the injector mounting holes and a load resulting from the compression of the O-rings translates directly into an insertion load required to insert the injectors into the injector mounting holes.

With an injector unit comprising a plurality of injectors each having an O-ring is installed, all of the O-rings are compressed at substantially the same time. Consequently, the insertion load of the injectors becomes large and the task of mounting the injector unit becomes difficult.

An object of the present invention is to provide an injector mounting structure that can improve the installation performance of an injector unit. A means by which at least a portion of this object can be achieved will now be explained.

A fuel injector assembly according to one aspect of the present invention includes a modular fuel injector unit and a cylinder head side member. The modular fuel injector unit includes a first fuel injector with a first seal, a second fuel injector with a second seal and a fuel distribution pipe fluidly communicating with the first and second fuel injectors to distribute a fuel to the first and second fuel injectors, with the first and second fuel injectors and the fuel distribution pipe being coupled together as a single installable unit. The cylinder head side member includes a first insertion hole with a first fitting section that receives the first seal and a second insertion hole with a second fitting section that receives the second seal. The first and second insertion holes of the cylinder head side member and the first and second seals of the first and second fuel injectors are arranged with respect to each other such that as the modular fuel injector unit is being mounted to the cylinder head side member by inserting the first and second fuel injectors into the first and second insertion holes formed in the cylinder head side member, respectively, the first seal undergoes a maximum compressive deformation in the first fitting section at a time that does not coincide with a time that the second seal undergoes a maximum compressive deformation in the second fitting section.

With the fuel injector assembly according to the above described aspect of the present invention, a time when the first seal member undergoes a maximum compressive deformation in the first fitting section does not coincide with a time when the second seal member undergoes a maximum compressive deformation in the second fitting section. Consequently, the insertion load incurred when the modular fuel injector unit is installed onto a cylinder head side member can be reduced. As a result, the modular fuel injector unit can be installed more easily.

The cylinder head side member may include a cylinder head main body, an intake manifold attached to the cylinder head main body, and/or an adapter plate used to when the intake manifold is attached to the cylinder head main body.

The first and second insertion holes of the cylinder head side member and the first and second seals of the first and second fuel injectors may be arranged with respect to each other such that the second seal begins to undergo a compressive deformation in the second fitting section after the first seal has undergone a maximum compressive deformation in the first fitting section as the first and second fuel injectors are inserted into the first and second insertion holes, respectively.

Since the second seal member starts to undergo compressive deformation in the second fitting section after the first seal member has undergone a maximum compressive deformation in the first fitting section, the compressive deformation of the second seal member can be started after a maximum compressive load has been generated by the compressive deformation of the first seal member when the modular fuel injector unit is installed onto a cylinder head side member. In other words, the timings at which the insertion loads of the injectors reach their respective peaks when the modular fuel injector unit is installed onto the cylinder head side member can be offset from each other.

The first and second insertion holes of the cylinder head side member and the first and second seals of the first and second fuel injectors may be arranged with respect to each other such that the second seal begins to undergo a compressive deformation in the second fitting section after the first and second fuel injectors have been inserted simultaneously into the first and second insertion holes, respectively, by a prescribed stroke amount beyond a position where the first seal reached a maximum compressive deformation in the first fitting section. Since the second seal member starts to undergo compressive deformation in the second fitting section after the insertion load of the first seal member in the first insertion hole has decreased from a maximum insertion load, the insertion load incurred when the modular fuel injector unit is installed onto a cylinder head side member can be reduced more effectively.

The first and second insertion holes of the cylinder head side member and the first and second seals of the first and second fuel injectors may be arranged with respect to each other such that the prescribed stroke amount is preset to such a value that an insertion load imposed on the first insertion hole by the first fuel injector decreases from a maximum load state in which the insertion load is at a maximum load to a minimum load state in which the insertion load has decreased to a minimum load. In this way, the insertion load incurred when the modular fuel injector unit is installed onto a cylinder head side member can be reduced to the greatest degree possible.

The first fitting section may be located in the first insertion hole of the cylinder head side member at a position that is shallower along a depth direction of first insertion hole than a position of the second fitting section in the second insertion hole with respect to the depth direction of second insertion hole. In this way, the timings at which the insertion loads of the injectors reach their respective peaks when the modular fuel injector unit is attached to the cylinder head side member can be offset from each other by simply making the position where the first fitting section is formed shallower along a depth direction than the position where the second fitting section is formed.

The cylinder head side member may be part of a cylinder head main body that forms a part of the combustion chamber for a cylinder. The first and second insertion holes may be arranged with respect to the combustion chamber such that fuel is injected from both of the first and second fuel injectors into the same combustion chamber. In this way, the insertion load incurred when an injector unit having multiple injectors, e.g., a twin-injector type having two injectors arranged to inject fuel into each combustion chamber, is mounted to a cylinder head side member. As a result, even a twin-injector type modular fuel injector unit can be installed easily.

The modular fuel injector unit may further include at least one of an additional first fuel injector and an additional second fuel injector with the at least one of the additional first fuel injector and the additional second fuel injector fluidly communicating with the fuel distribution pipe. The cylinder head side member may further include at least one of an additional first insertion hole and an additional second insertion hole corresponding to the at least one of the additional first fuel injector and the additional second fuel injector. The cylinder head main body may include a plurality of combustion chambers arranged in a straight row, with the first and second insertion holes and the at least one of the additional first insertion hole and the additional second insertion hole of the cylinder head side member being arranged symmetrically with respect to a central perpendicular plane that is perpendicular to a direction along which the combustion chambers are arranged in the straight row and arranged to pass through a central position along the row of combustion chambers. Since the first insertion hole and the second insertion hole are arranged symmetrically with respect to a central perpendicular plane that is perpendicular to a direction along which the combustion chambers are arranged in a straight row and arranged to pass through a central position along the row of combustion chambers, the insertion load incurred when the modular fuel injector unit is installed can be distributed symmetrically with respect to the central perpendicular plane. As a result, the modular fuel injector unit can be installed even more easily.

The cylinder head side member may be part of a cylinder head main body that forms parts of a plurality of combustion chambers for cylinders that are arranged in a straight row. The first and second insertion holes may be arranged with respect to the combustion chambers such that fuel injected from the first and second fuel injectors are injected into different combustion chambers, respectively. Since the timings at which compression loads are generated when the seal members start to undergo compressive deformation can be varied among the combustion chambers, the insertion load incurred when the modular fuel injector unit is installed onto the cylinder head side member can be reduced. As a result, the modular fuel injector unit can be installed more easily.

The modular fuel injector unit may further include at least one of an additional first fuel injector and an additional second fuel injector with the at least one of the additional first fuel injector and the additional second fuel injector fluidly communicating with the fuel distribution pipe. The cylinder head side member may further include at least one of an additional first insertion hole and an additional second insertion hole corresponding to the at least one of the additional first fuel injector and the additional second fuel injector. The first and second insertion holes and the at least one of the additional first insertion hole and the additional second insertion hole of the cylinder head side member may be arranged symmetrically with respect to a central perpendicular plane that is perpendicular to a direction along which the combustion chambers are arranged in the straight row and arranged to pass through a central position along the row of combustion chambers. Since the first insertion hole and the second insertion hole are arranged symmetrically with respect to a central perpendicular plane that is perpendicular to a direction along which the combustion chambers are arranged in a straight row and arranged to pass through a central position along the row of combustion chambers, the insertion load incurred when the modular fuel injector unit is installed can be distributed symmetrically with respect to the central perpendicular plane. As a result, the modular fuel injector unit can be installed even more easily.

The first seal may be attached to the first fuel injector at a first position that is more forward than a position of the second seal of the second fuel injector with respect to an insertion direction in which the first fuel injector is inserted into the first insertion hole and the second fuel injector is inserted into the second insertion hole. As a result, the timings at which the insertion loads of the injectors reach their respective peaks when the modular fuel injector unit is installed onto the cylinder head side member can be offset from each other by simply varying the positions where the first seal member and the second seal member are attached.

A cylinder head side member according to another aspect of the present invention includes a first fuel injector mounting section and a second fuel injector mounting section. The first fuel injector mounting section includes a first insertion hole that is configured to receive a first fuel injector having a first seal. The second fuel injector mounting section includes a second insertion hole that is configured to receive a second fuel injector having a second seal. The first insertion hole is partially defined by a first fitting section configured to receive the first seal of the first fuel injector therein. The second insertion hole is partially defined by a second fitting section configured to receive the second seal of the second fuel injector therein. The first fitting section is located along an axial direction of the first insertion hole at a first axial position and the second fitting section is located along an axial direction of the second insertion hole at a second axial position with the first and second axial positions being arranged such that the first seal undergoes a maximum compressive deformation in the first fitting section at a time that does not coincide with a time that the second seal undergoes a maximum compressive deformation in the second fitting section as the first and second fuel injectors are inserted into the first and second insertion holes, respectively.

With a cylinder head side member according to the above described aspect of the present invention, the insertion load incurred when a modular fuel injector unit is attached to the cylinder head side member can be reduced because a positional relationship of the first fitting section formed in the first insertion hole and the second fitting section formed in the second insertion hole is such that when the first injector and the second injector are inserted, a time when the first seal member undergoes a maximum compressive deformation in the first fitting section does not coincide with a time when the second seal member undergoes a maximum compressive deformation in the second fitting section. As a result, the modular fuel injector unit can be installed more easily. The cylinder head side member includes a cylinder head main body, an intake manifold attached to the cylinder head main body, and an adapter plate used to when the intake manifold is attached to the cylinder head main body.

The first and second axial positions may be arranged such that the second seal begins to undergo a compressive deformation in the second fitting section after the first seal has undergone a maximum compressive deformation in the first fitting section as the first and second fuel injectors are inserted into the first and second insertion holes, respectively. By contriving the positional relationship of the first fitting section formed in the first insertion hole and the second fitting section formed in the second insertion hole such that the second seal member starts to undergo compressive deformation in the second fitting section after the first seal member has undergone a maximum compressive deformation in the first fitting section, the compressive deformation of the second seal member can be started after a maximum compressive load has been generated by the compressive deformation of the first seal member when the modular fuel injector unit is installed onto a cylinder head side member. In other words, the timings at which the insertion loads of the injectors reach their respective peaks when the modular fuel injector unit is installed onto the cylinder head side member can be offset from each other.

The first and second axial positions may be arranged such that the second seal begins to undergo a compressive deformation in the second fitting section after the first seal has undergone a maximum compressive deformation in the first fitting section as the first and second fuel injectors are inserted into the first and second insertion holes, respectively. Since the second seal member starts to undergo compressive deformation in the second fitting section after the insertion load of the first seal member in the first insertion hole has decreased from a maximum insertion load, the insertion load incurred when the modular fuel injector unit is installed onto a cylinder head side member can be reduced more effectively. The prescribed stroke amount may be set to such a value that an insertion load imposed on the first insertion hole by the first fuel injector decreases from a maximum load state in which the insertion load is at a maximum load to a minimum load state in which the insertion load has decreased to a minimum load. In this way, the insertion load incurred when the modular fuel injector unit is installed onto a cylinder head side member can be reduced to the greatest degree possible.

The first fitting section may be located in the first insertion hole of the cylinder head side member at a position that is shallower along a depth direction of first insertion hole than a position of the second fitting section in the second insertion hole with respect to the depth direction of second insertion hole. In this way, the timings at which the insertion loads of the injectors reach their respective peaks when the modular fuel injector unit is attached to the cylinder head side member can be offset from each other by simply making the position where the first fitting section is formed shallower along a depth direction than the position where the second fitting section is formed.

The first insertion hole may be partially defined by a first tapered section that is formed at a rearward end of the first fitting section of the first insertion hole with respect to an insertion direction in which the first fuel injector is inserted into the first insertion hole with the first tapered section gradually increasing in diameter in a rearward direction towards an entrance opening of the first insertion hole. The second insertion hole may be partially defined by a second tapered section that is formed at a rearward end of the second fitting section of the second insertion hole with respect to an insertion direction in which the second fuel injector is inserted into the second insertion hole with the second tapered section gradually increasing in diameter in a rearward direction towards an entrance opening of the second insertion hole. In this way, the compressive deformation of the seal members can be made to occur gradually and the injectors can be inserted more easily.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
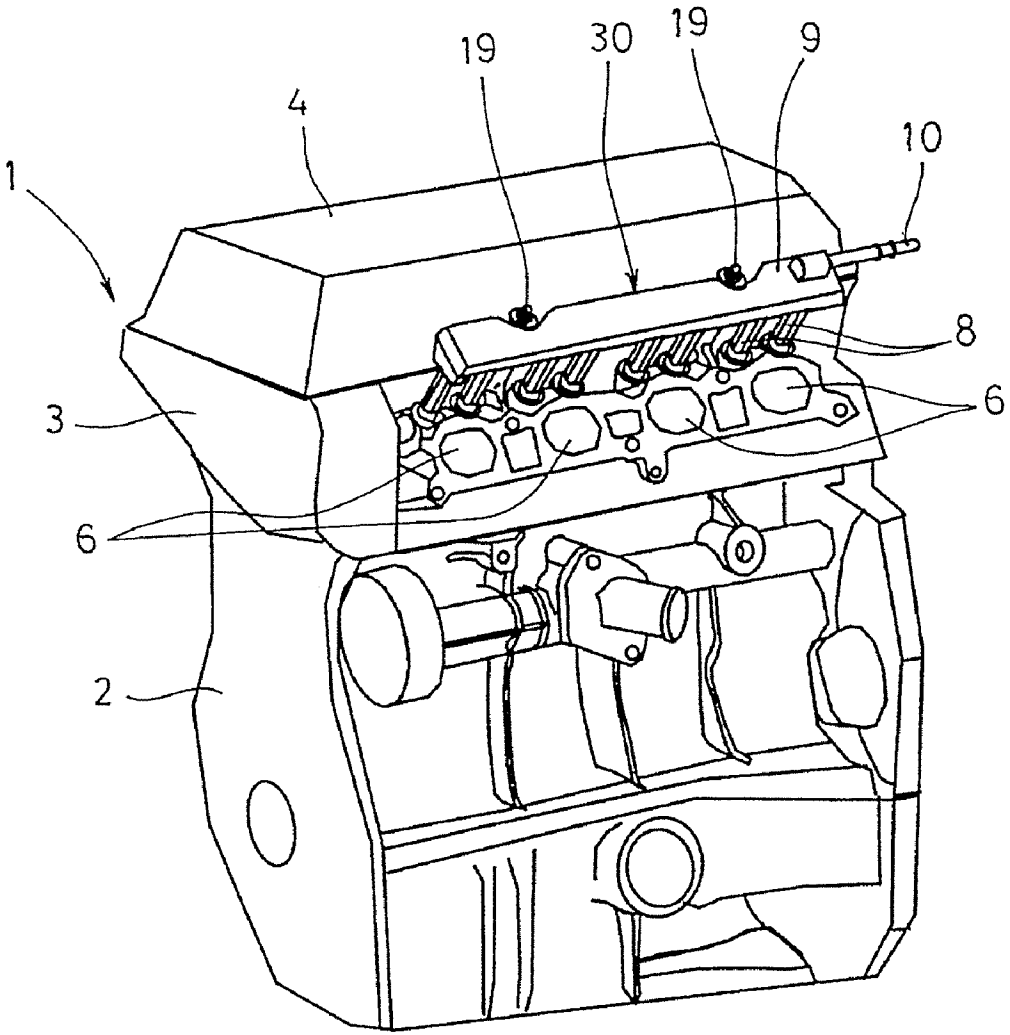
FIG. 1 is a schematic view of an engine 1 equipped with an injector unit.
Figure 2:
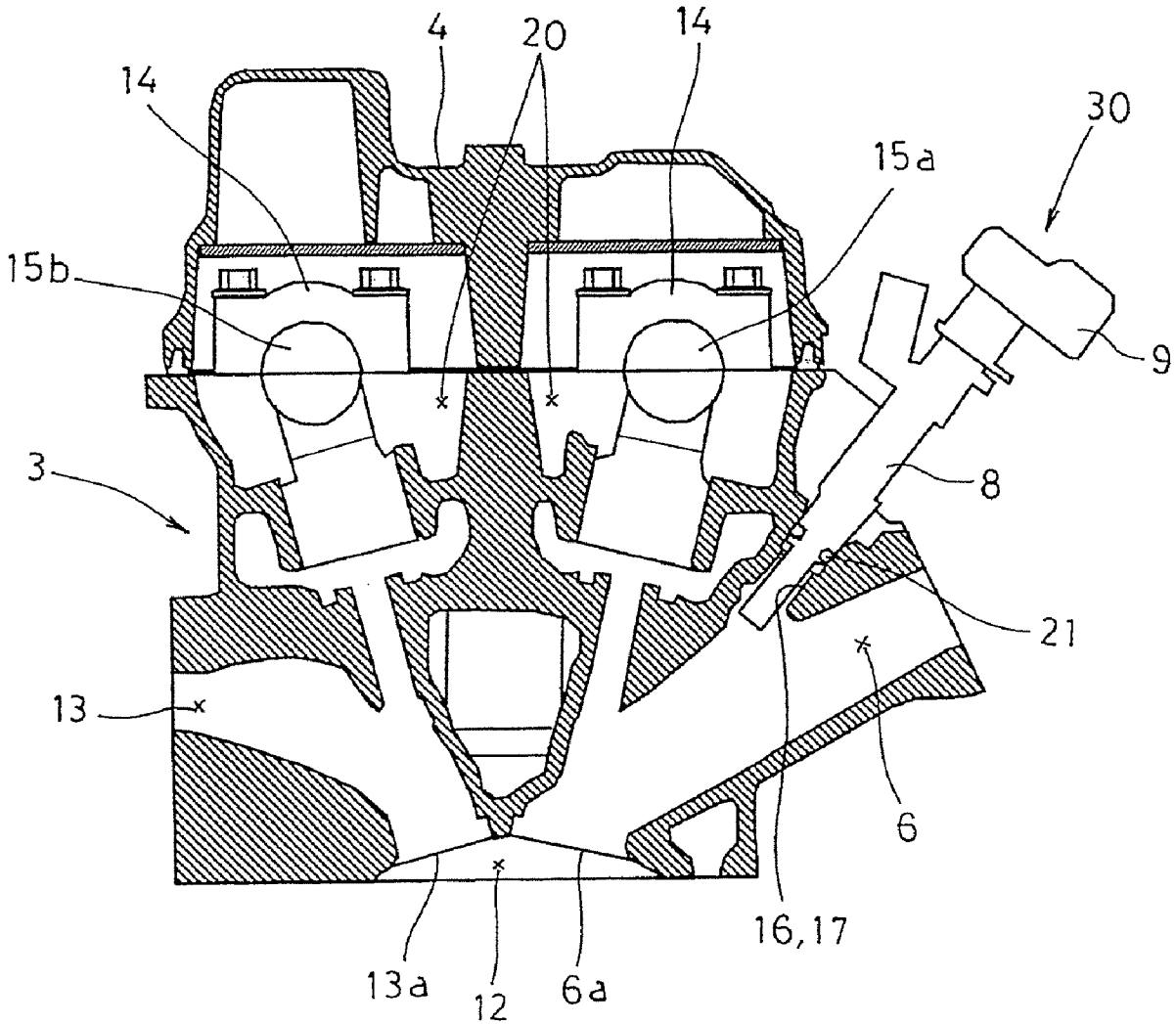
FIG. 2 is an enlarged vertical cross sectional view showing main components of the engine 1.
Figure 3:
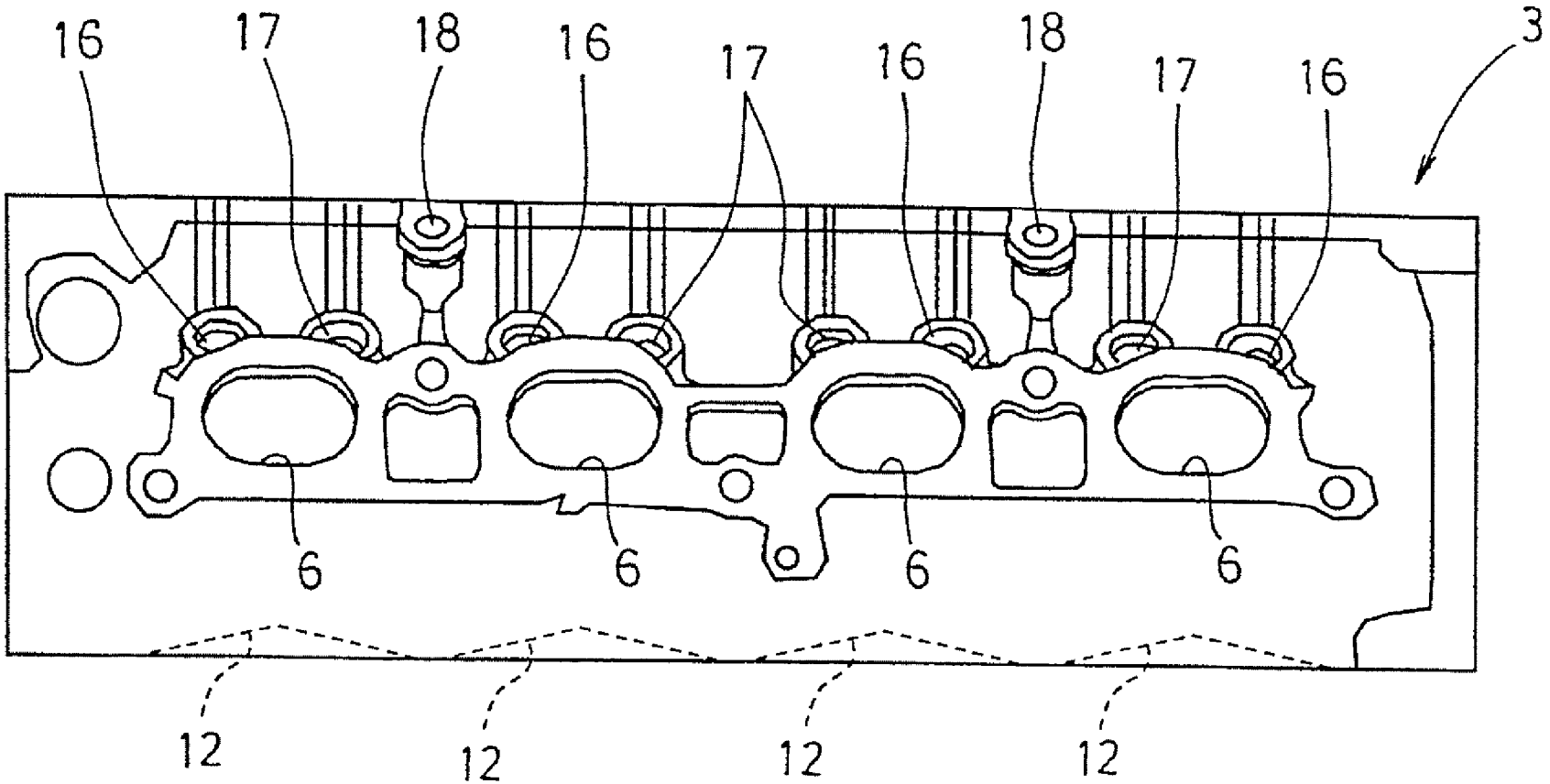
FIG. 3 is an enlarged side view showing main components of a cylinder head 3 as viewed from an intake passage side.
Figure 4:
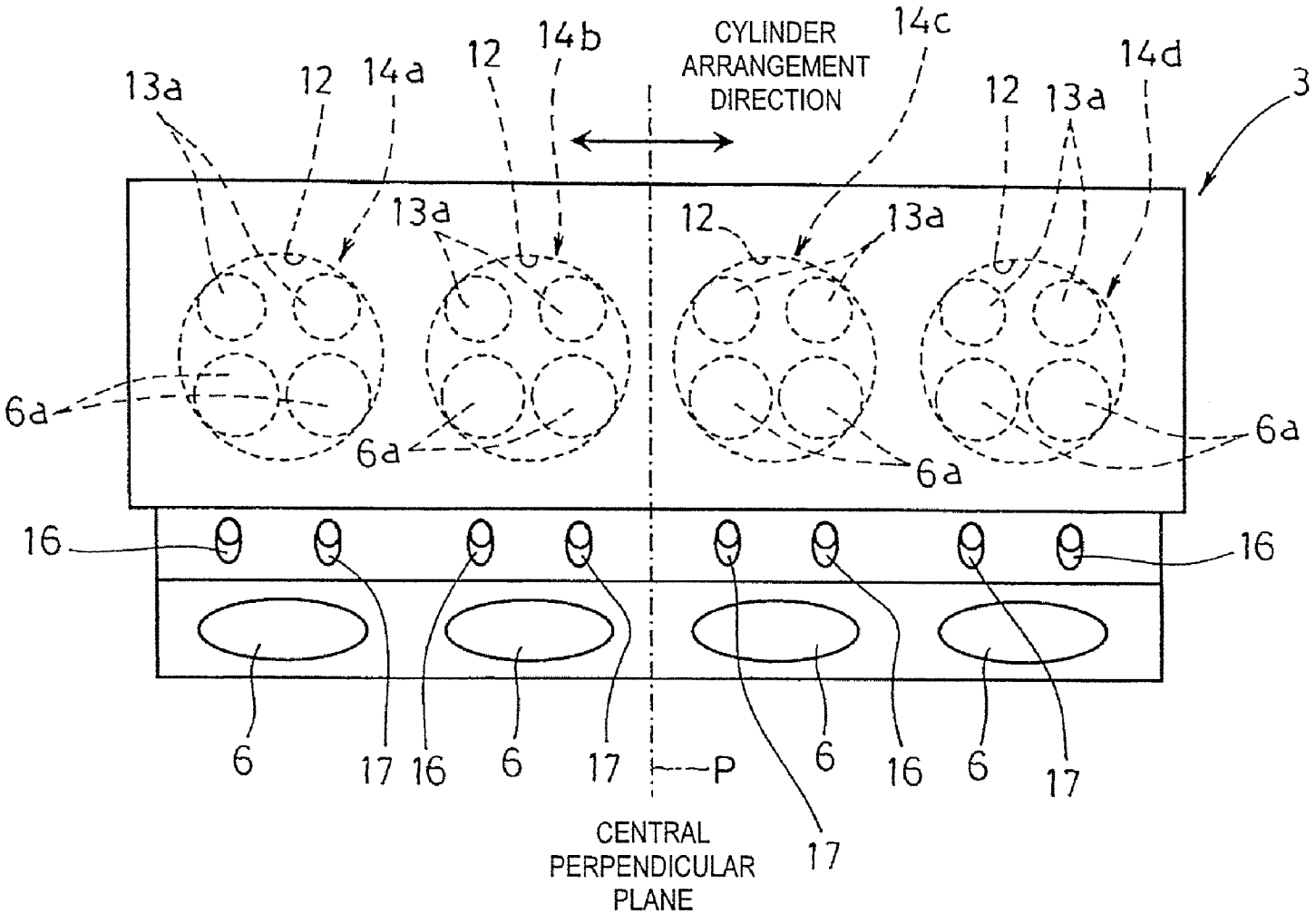
FIG. 4 is an enlarged plan view of the cylinder head.
Figure 5:
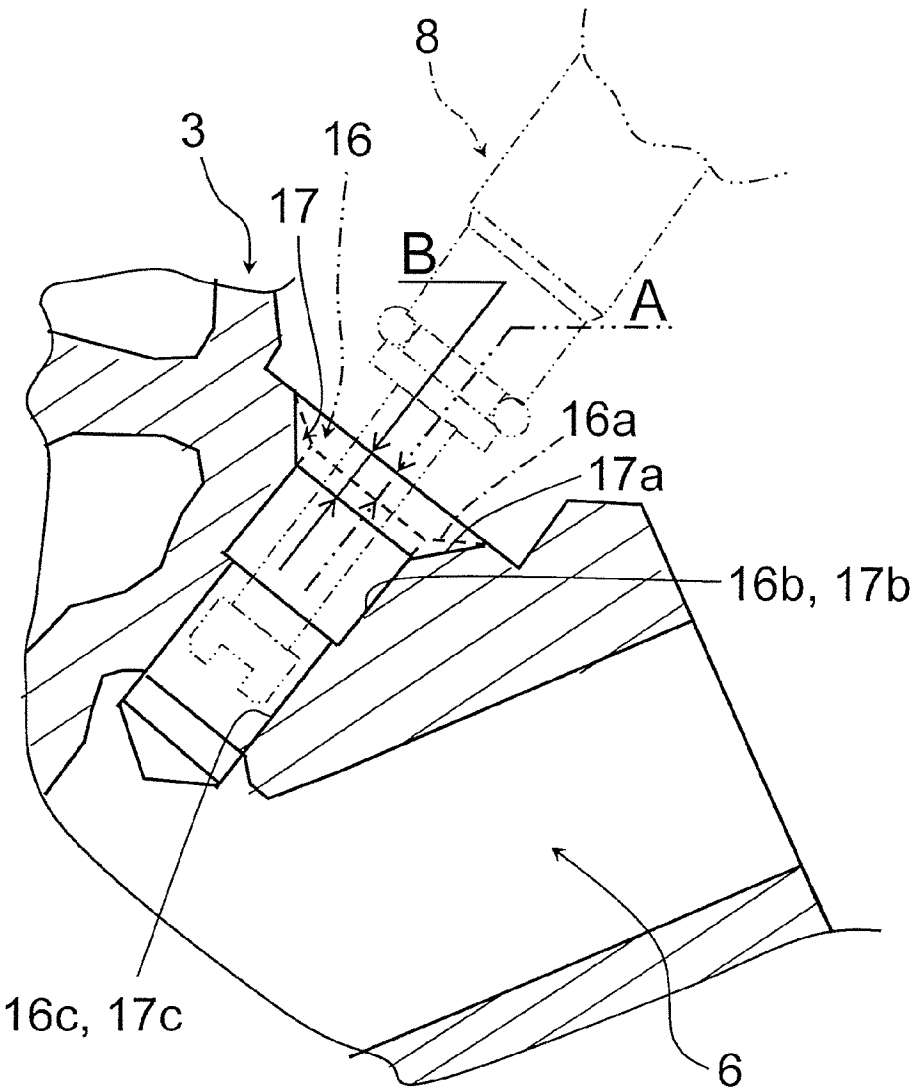
FIG. 5 is an enlarged cross sectional view of an insertion hole formed in the cylinder head for installing an injector.

FIG. 1 is a schematic view of an engine 1 equipped with a fuel injector assembly according to an embodiment of the present invention; FIG. 2 is an enlarged vertical cross sectional view of the engine 1; FIG. 3 is an enlarged side view showing main components of a cylinder head 3 (an example of a cylinder head side member) as viewed from an intake passage side; FIG. 4 is an enlarged plan view of the cylinder head; FIG. 5 is an enlarged cross sectional view of an insertion hole formed in the cylinder head for installing an injector.

As shown in FIG. 1, the engine 1 includes a cylinder block 2, a cylinder head 3 arranged on the cylinder block 2, a cylinder head cover 4 attached to the cylinder head 3, and an injector unit 30 (modular fuel injector unit) mounted to the cylinder head 3.

As shown in FIGS. 2, 3, and 4, the cylinder head 3 includes combustion chambers 12, camshafts 15*a* and 15*b* housed in a valve operating mechanism chamber 20, intake passages 6 connected to each of the combustion chambers 12 through intake ports 6*a*, exhaust passages 13 connected to each of the combustion chambers 12 through exhaust ports 13*a*, bolt holes 18 configured to mesh with bolts 19 used to fasten the injector unit 30 in place, and insertion holes 16 and 17 configured for injectors 8 (explained later) of the injector unit 30 to be inserted into. The cylinder head 3 is configured to accommodate an in-line four cylinder engine having a first cylinder 14*a*, a second cylinder 14*b*, a third cylinder 14*c*, and a fourth cylinder 14*d* arranged in a straight row (arranged from left to right in FIG. 4). The combustion chambers 12 are arranged in a straight row in positions corresponding to the cylinders 14*a*, 14*b*, 14*c*, and 14*d*.

As shown in FIGS. 2, 3, and 4, there are two insertion holes 16 and 17 provided with respect to each of the intake passages 6. Each of the insertion holes 16 and 17 is formed to pass from a portion located above and outside the respective intake passage 6 (above in FIGS. 2, 3, and 4) to the inside of the intake passage 6 so as to form a prescribed angle with respect to the intake passage 6. In other words, the cylinder head 3 is configured for a so-called twin injector type fuel injection format. As shown in FIG. 5, each of the insertion holes 16 and 17 has a tapered section 16*a* or 17*a* configured to gradually taper to a smaller diameter from the outside of the cylinder head 3 toward the inside (i.e., the internal diameter gradually increases from a more forward position toward a more rearward position with respect to an insertion direction of an injector 8 explained later), a fitting section 16*b* or 17*b* continuing from the tapered section 16*a* or 17*a*, and a passage section 16*c* or 17*c* continuing from the fitting section 16*b* or 17*b*. The tapered section 16*a* or 17*a*, the fitting section 16*b* or 17*b*, and the passage section 16*c* or 17*c* are arranged in order as listed from the outside of the cylinder head 3 toward the inside of the cylinder head 3.

A depth A of the tapered section 16*a* of an insertion hole 16 is smaller than a depth B of the tapered section 17*a* of an insertion hole 17. That is, the position where the fitting section 16*b* of an insertion hole 16 starts is shallower in a depth direction than the position where the fitting section 17*b* of an insertion hole 17 starts. The depths A and B are set such that a seal ring 21 arranged on an injector 8 entering an insertion hole 17 starts to undergo compressive deformation in the fitting section 17*b* when the injector unit 30 has been pushed toward the cylinder head 3 beyond a point where a seal ring 21 arranged on an injector 8 entering an insertion hole 16 reached a maximum compressive deformation in the fitting section 16*b* (i.e., a point where an insertion load required to insert the injector 8 into the insertion hole 16 reached a maximum value) and has reached a point where the insertion load required to insert the injector 8 into the insertion hole 16 has decreased as much as it will.

Figure 6:
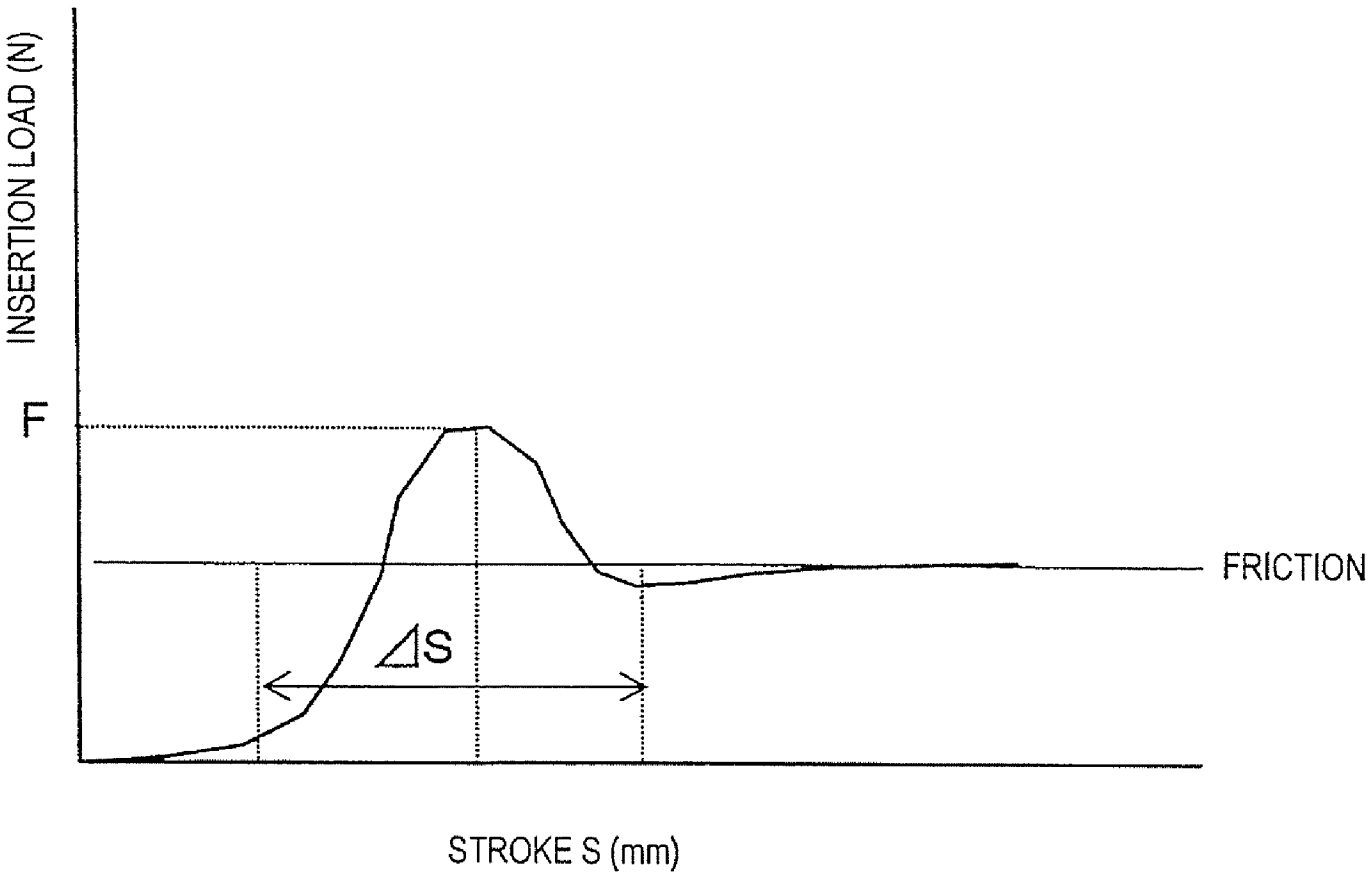
FIG. 6 is a characteristic curve indicating an insertion load incurred when an injector is inserted into an insertion hole.

In this embodiment, the depth B is set based on an insertion load curve indicating how the insertion load changes when one injector 8 is inserted into an insertion hole 16. The insertion load curve is obtained in advance experimentally. A stroke amount ΔS is measured from a position on the insertion load curve where the insertion load of the injector 8 begins to occur to a position where the insertion load has decreased from a peak insertion load F to a load corresponding to a friction force of the seal ring 21 (described later). The depth B is set to a value equal to the sum of the stroke amount ΔS and the depth A. An example of an insertion load curve is shown in FIG. 6.

As shown in FIG. 4, the insertion holes 16 and 17 are arranged in the cylinder head 3 to be symmetrical with respect to a central perpendicular plane P that is perpendicular to a direction along which the cylinders are arranged in a straight row and arranged to pass through a central position along the row of four combustion chambers 12. That is, the insertion holes 16 and 17 corresponding to each of the first cylinder 14*a* and the second cylinder 14*b* are arranged with the insertion hole 16 on the left and the insertion hole 17 on the right when viewed as shown in FIG. 4, and the insertion holes 16 and 17 corresponding to each of the third cylinder 14*c* and the fourth cylinder 14*d* are arranged with the insertion hole 17 on the left and the insertion hole 16 on the right when viewed as shown in FIG. 4.

As shown in FIGS. 1 and 2, the injector unit 30 includes eight injectors 8 for injecting fuel, seal rings 21 attached to each of the eight injectors 8, and fuel distribution pipe 9 configured and arranged to supply fuel to the eight injectors 8. The injector unit 30 is fastened to the cylinder head 3 with bolts 19.

Figure 7:
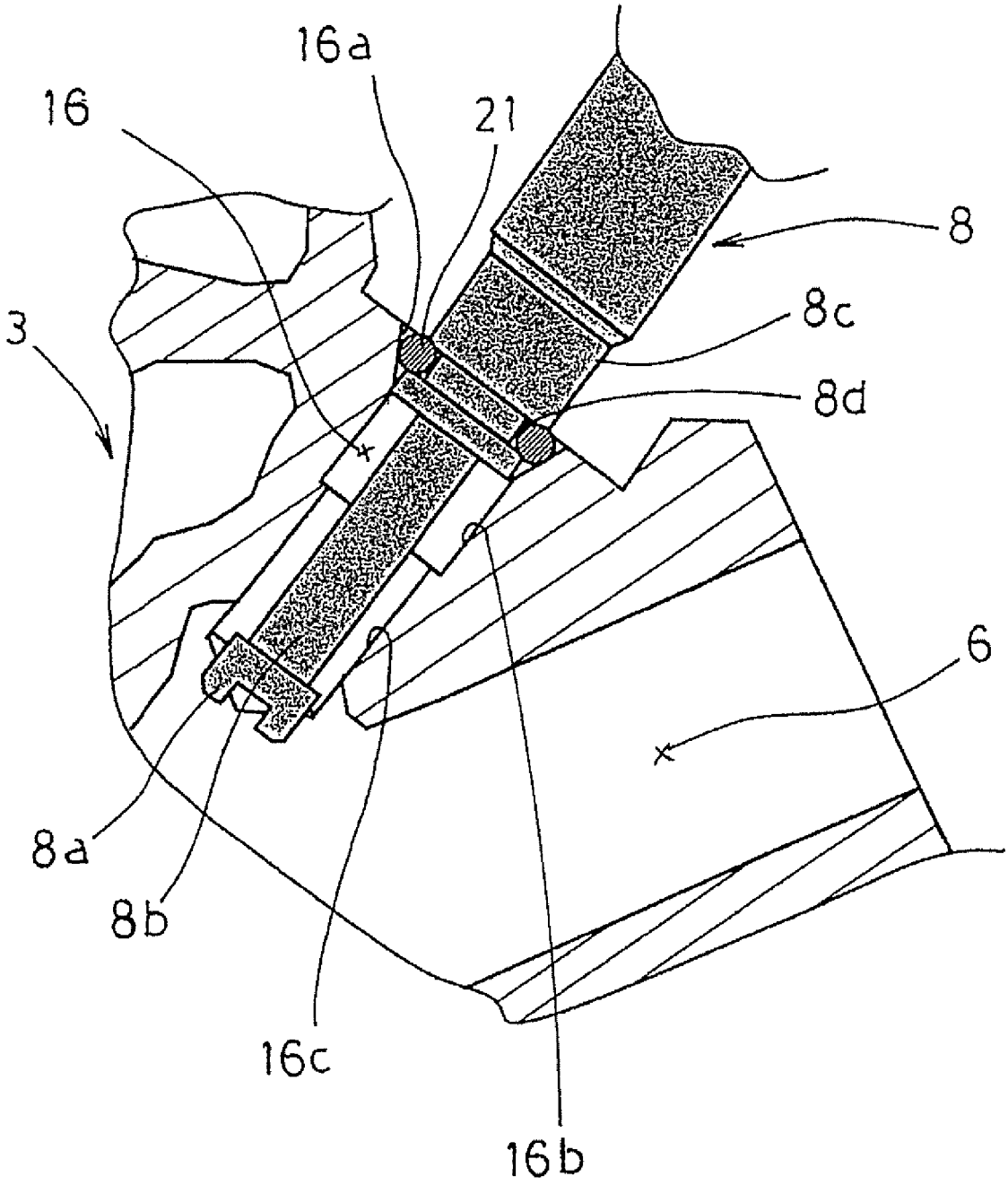
FIG. 7 illustrates an injector 8 in an initial state of being inserted into an insertion hole 16.

As shown in FIG. 7, each of the injectors 8 has a nozzle section 8*b* provided with a tip injection section 8*a* from which fuel is injected, a fitting section 8*c* provided with a ring groove 8*d* for attaching a seal ring 21, and a base section (not shown) configured to be inserted into the fuel distribution pipe 9. Each of the eight injectors 8 has the same shape. The fuel distribution pipe 9 has an integral connecting section 10 for connecting to a fuel pipe (not shown) through which fuel is supplied from a fuel pump (not shown).

Figure 8:
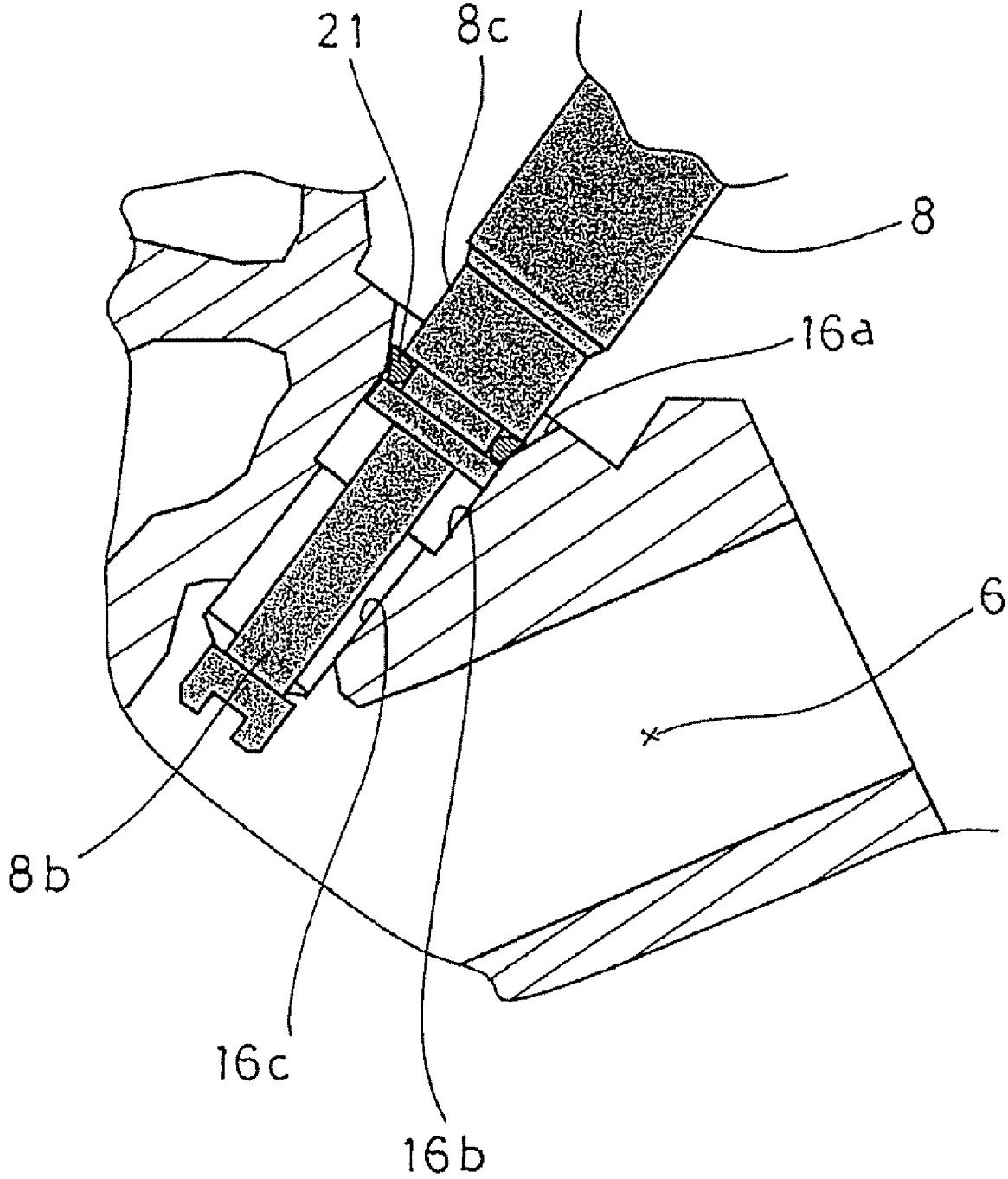
FIG. 8 depicts an injector 8 inserted into an insertion hole 16 to such a degree that a seal ring 21 has begun to be compressed, thereby illustrating how the state of the seal ring changes as the injector is inserted.
Figure 9:
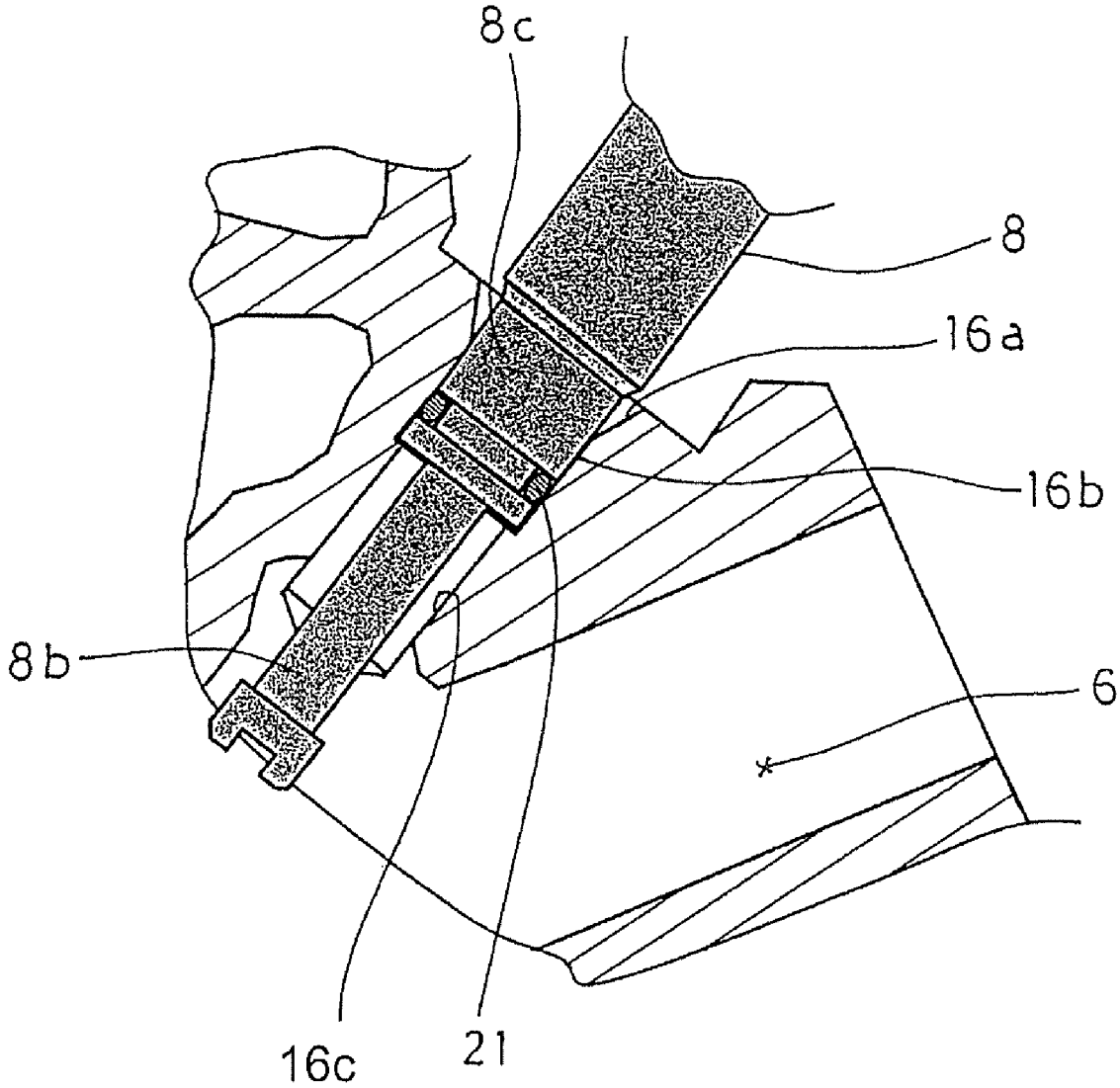
FIG. 9 depicts an injector 8 fully inserted into an insertion hole 16, thereby illustrating how the state of the seal ring changes as the injector is inserted.
Figure 10:
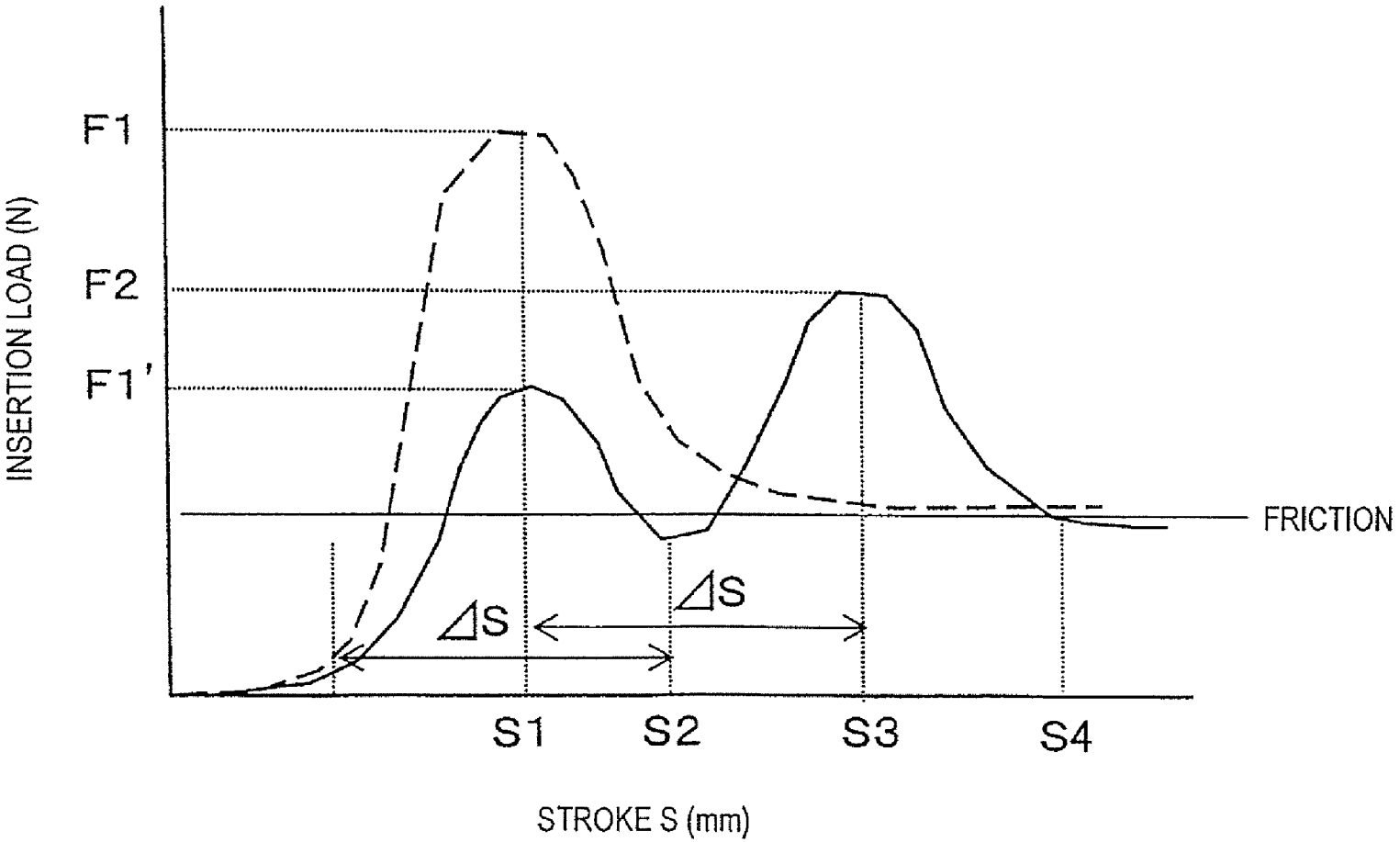
FIG. 10 is a plot showing how an insertion force varies when an injector unit 30 is installed onto a cylinder head 3.

What occurs during the process of installing an injector unit 30 onto a cylinder head 3 using an injector mounting structure according to the embodiment will now be explained. FIGS. 7, 8, and 9 illustrate how the state of the seal ring 21 changes as an injector 8 is inserted into an insertion hole 16, and FIG. 10 is a plot showing how an insertion force varies when an injector unit 30 is installed onto a cylinder head 3. With the eight injectors 8 inserted into the insertion holes 16 and 17, the injector unit 30 is pressed toward the cylinder head 3. At an initial stage, the seal rings 21 of the four injectors 8 inserted into the insertion holes 16 contact the tapered sections 16*a* as shown in FIG. 7. At this time, the seal rings 21 the four injectors 8 inserted into the insertion holes 17 remain separated from the tapered sections 17*a*. As the injector unit 30 is pushed farther toward the cylinder head 3, the seal rings 21 of the four injectors 8 inserted into the insertion holes 16 begin to undergo compressive deformation and the insertion force required to insert the injectors 8 increases (this stage corresponds to the section of FIG. 10 up to where the stroke amount S reaches a value S1). Since the compressive deformation of the seal rings 21 occurs gradually due to the tapered sections 16*a*, the insertion force increases in a comparatively smooth fashion and the injectors 8 are easy to insert.

When the stroke amount S reaches the value S1, the compressive deformation of the seal rings 21 inside the insertion holes 16 is at a maximum and the insertion force required to insert the injectors 8 into the insertion holes 16 is at a peak value F1'. At this stage, a majority of each of the seal rings 21 in the insertion holes 16 has been compressed to substantially the same diameter as the fitting section 16*b* (FIG. 8). Meanwhile, the seal rings 21 of the four injectors 8 inserted into the insertion holes 17 still have not contacted the tapered sections 17*a* and, thus, have not undergone any compressive deformation. As the injector unit 30 is pushed further toward the cylinder head 3 from where the stroke amount S equals the value S1, the insertion force decreases because the deformation of the seal rings 21 in the insertion holes 16 merely changes from a state in which a majority of each of the seal rings 21 has been compressed to substantially the same diameter as the fitting section 16*b* to a state in which the entirety of each of the seal rings 21 has been compressed to substantially the same diameter as the fitting section 16*b* (this stage corresponds to a section of FIG. 10 where the stroke amount S ranges from the value S1 to the value S2). In this embodiment, the stroke amount S ranging from the value S1 to the value S2 in FIG. 10 corresponds to a prescribed stroke amount by which the injectors 8 move in the insertion direction before the seal rings 21 of the injectors 8 inserted into the insertion holes 17 begin to undergo a compressive deformation. After the stroke amount S reaches the value S2, the insertion force decreases to a value substantially equal to a friction force of the seal rings 21 because the seal rings 21 have been compressed to substantially the same diameter as the fitting sections 16*b* as shown in FIG. 9 and the seal rings 21 are merely being moved inside the fitting sections 16*b* (this stage corresponds to a section of FIG. 10 where the stroke amount S equals the value S2). At substantially the same time, the seal rings 21 of the four injectors 8 inserted into the insertion holes 17 contact the tapered sections 17*a* and begin to undergo compressive deformation. From this stage, the insertion force increases until the stroke amount S reaches a value S3. Since the compressive deformation of the seal rings 21 occurs gradually due to the tapered sections 17*a*, the insertion force increases in a comparatively smooth fashion and the injectors 8 are easy to insert.

When the stroke amount S reaches the value S3, the compressive deformation of the seal rings 21 inside the insertion holes 17 is at a maximum and the insertion force required to insert the injectors 8 into the insertion holes 17 is at a peak value F2. At this stage, the insertion force begins to decrease because a majority of each of the seal rings 21 in the insertion holes 17 has been compressed to substantially the same diameter as the fitting section 17*b* and further insertion merely compresses the remainder of each of the seal rings 21 to substantially the same diameter as the fitting sections 17*b* (this stage corresponds to a section of FIG. 10 where the stroke amount S ranges from the value S3 to a value S4). After the stroke amount S reaches the value S3, the insertion force decreases to a value substantially equal to a friction force of the seal rings 21 because the seal rings 21 have been compressed to substantially the same diameter as the fitting sections 17*b* and the seal rings 21 are merely being moved inside the fitting sections 17*b* (this stage corresponds to a section of FIG. 10 where the stroke amount S equals the value S4). When the stroke amount S reaches the value S4, the attachment of the injector unit 30 to the cylinder head 3 is finished.

The broken-line curve shown in FIG. 10 indicates how the insertion load would vary during attachment of the injector unit 30 to the cylinder head 3 if the insertion loads of the injectors 8 in the insertion holes 16 and the insertion loads of the injectors 8 in the insertion holes 17 reached peak values at the same time.

With the fuel injector assembly for an injector unit 30 according to the embodiment described above, the timing at which the insertion forces of the injectors 8 inserted into the insertion holes 16 reach a peak a is different from the timing at which the insertion forces of the injectors 8 inserted into the insertion holes 17 reach a peak b. Consequently, the insertion load incurred when attaching the injector unit 30 to the cylinder head 3 can be reduced. Since an insertion load begins to be incurred by the injectors 8 inserted into the insertion holes 17 when the insertion load of the injectors 8 inserted into the insertion holes 16 has decreased from a maximum insertion load to a load approximately equal to a friction force of the seal rings 21, the insertion load incurred when attaching the injector unit 30 to the cylinder head 3 can be reduced even more effectively. Also, the timing at which the insertion forces of the injectors 8 inserted into the insertion holes 16 reach a peak a can easily be offset from the timing at which the insertion forces of the injectors 8 inserted into the insertion holes 17 reach a peak b by simply making the position where the fitting section 16*b* of each of the insertion holes 16 starts shallower in a depth direction than the position where the fitting section 17*b* of each of the insertion holes 17 starts.

With the fuel injector assembly for an injector unit 30 according to the embodiment described above, the insertion holes 16 and 17 are arranged in the cylinder head 3 to be symmetrical with respect to a central perpendicular plane P that is perpendicular to a direction along which the cylinders are arranged in a straight row and arranged to pass through a central position along the row of four combustion chambers 12. Consequently, the insertion load incurred when the injector unit 30 is attached to the cylinder head 3 can be distributed symmetrically with respect to the central perpendicular plane P. That is, when the injector unit 30 is attached to the cylinder head 3, the injector unit 30 does not become slanted with respect to the direction in which the cylinders are arranged. As a result, the modular fuel injector unit can be installed even more easily.

In the fuel injector assembly for an injector unit 30 according to the embodiment described above, the insertion holes 16 and 17 corresponding to each of the first cylinder 14*a* and the second cylinder 14*b* are arranged with the insertion hole 16 on the left and the insertion hole 17 on the right when viewed as shown in FIG. 4, and the insertion holes 16 and 17 corresponding to each of the third cylinder 14*c* and the fourth cylinder 14*d* are arranged with the insertion hole 17 on the left and the insertion hole 16 on the right when viewed as shown in FIG. 4. However, any arrangement of the insertion holes 16 and 17 is acceptable so long as the insertion holes 16 and 17 are symmetrical with respect to a central perpendicular plane P that is perpendicular to a direction along which the cylinders are arranged in a straight row and passes through a central position along the row of four combustion chambers 12.

Figure 11:
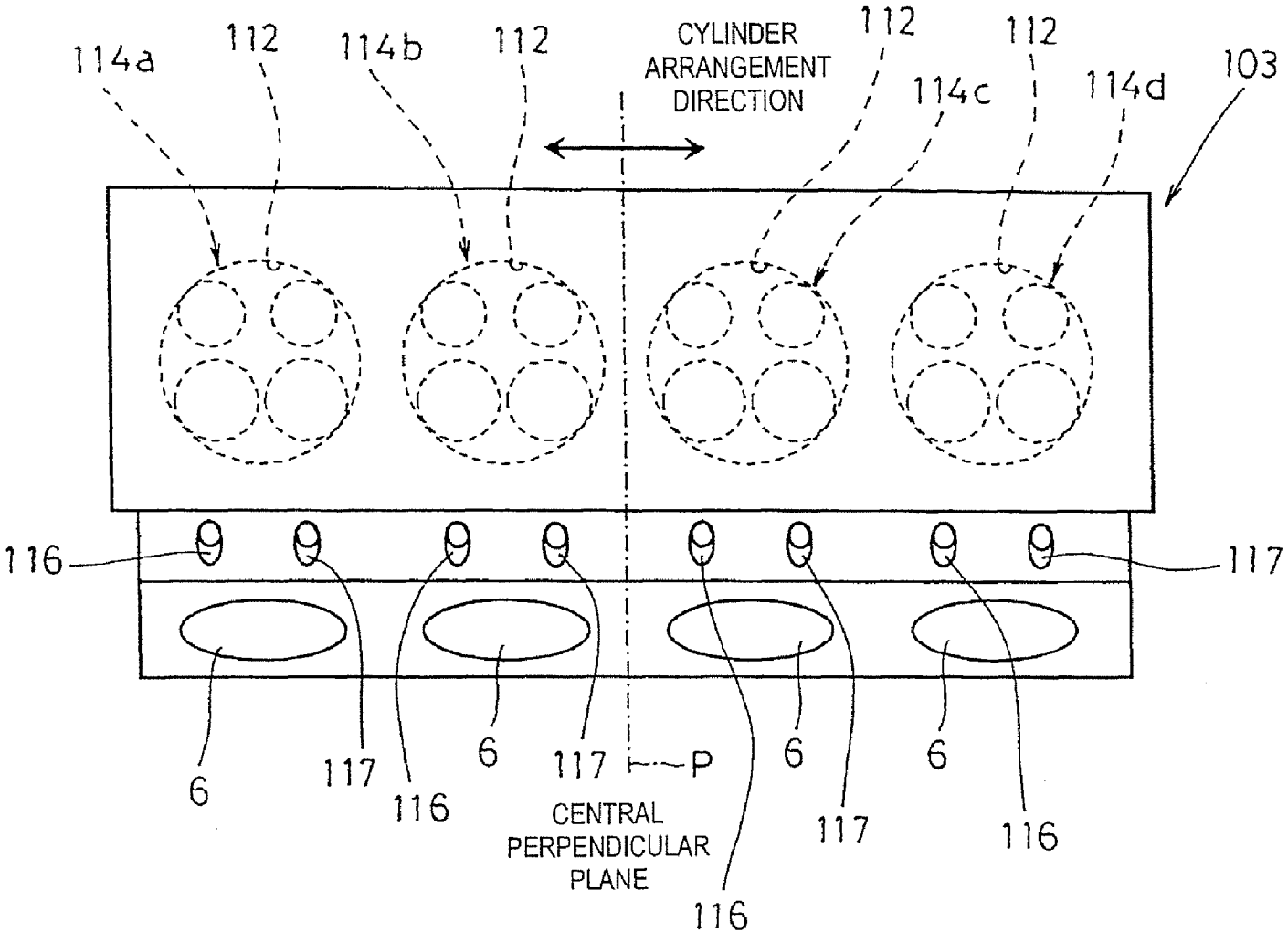
FIG. 11 is an enlarged plan view of a cylinder head according to a variation of the embodiment.

In the fuel injector assembly for an injector unit 30 according to the embodiment described above, the insertion holes 16 and 17 are symmetrical with respect to a central perpendicular plane P that is perpendicular to a direction along which the cylinders are arranged in a straight row and passes through a central position along the row of four combustion chambers 12. However, it is acceptable for the insertion holes to have an asymmetrical arrangement with respect to such a plane. For example, FIG. 11 shows an injector unit mounting structure according to a variation in which insertion holes 116 and 117 are arranged in a cylinder head 103 such the insertion holes 116 and 117 are asymmetrical with respect to a central perpendicular plane P that is perpendicular to a direction along which the cylinders are arranged in a straight row and passes through a central position along the row of four combustion chambers 112. More specifically, it is acceptable for the insertion holes 116 and 117 corresponding to each of the first cylinder 114*a*, the second cylinder 114*b*, the third cylinder 114*c*, and the fourth cylinder 114*d* to be arranged with the insertion hole 116 on the left and the insertion hole 117 on the right when viewed as shown in FIG. 11.

Figure 12:
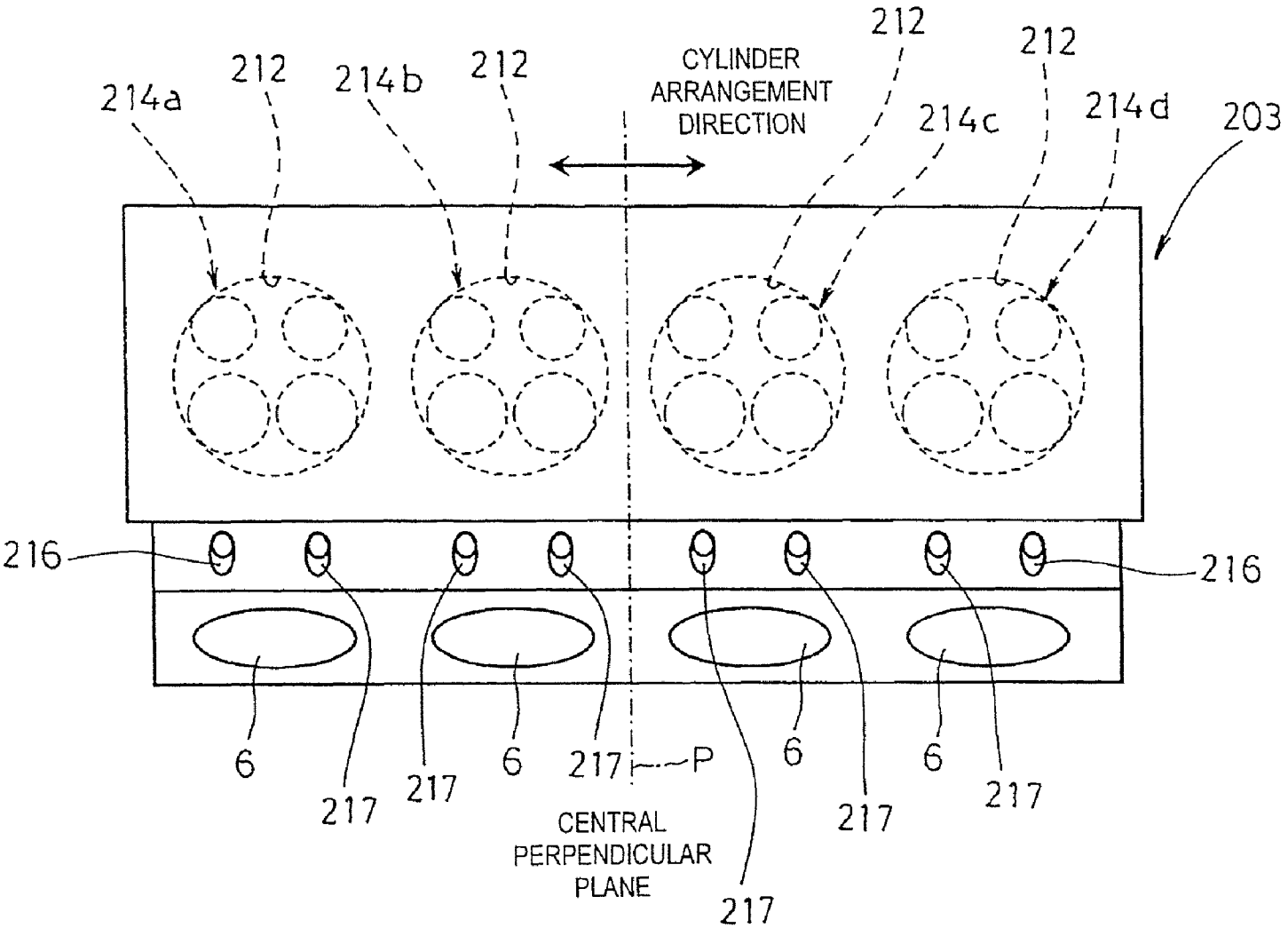
FIG. 12 is an enlarged plan view of a cylinder head according to a variation of the embodiment.

Although the number of insertion holes 16 provided in the cylinder head 3 is the same as the number of insertion holes 17 in the mounting structure of an injector unit 30 according to the embodiment described above, it is acceptable for the number of each type of insertion hole to be different. For example, FIG. 12 shows a cylinder head 203 used in an injector unit mounting structure according to a variation in which the number of insertion holes 216 is different from the number of insertion holes 217. In this variation, similarly to the embodiment, the insertion holes 216 and 217 are arranged symmetrically with respect to a central perpendicular plane P. More specifically, for example, an insertion hole 216 is arranged on the left and an insertion hole 217 is arranged on the right with respect to the first cylinder 214*a* when viewed as shown in FIG. 12, only insertion holes 217 are provided on both the left and right with respect to the second cylinder 214*b* and the third cylinder 214*c*, and an insertion hole 217 is arranged on the left and an insertion hole 216 is arranged on the right with respect to the fourth cylinder 214*d* when viewed as shown in FIG. 12. Consequently, the injector unit does not become slanted with respect to the direction in which the cylinders are arranged when the injector unit is attached to the cylinder head 203. As a result, the modular fuel injector unit can be installed even more easily.

Figure 13:
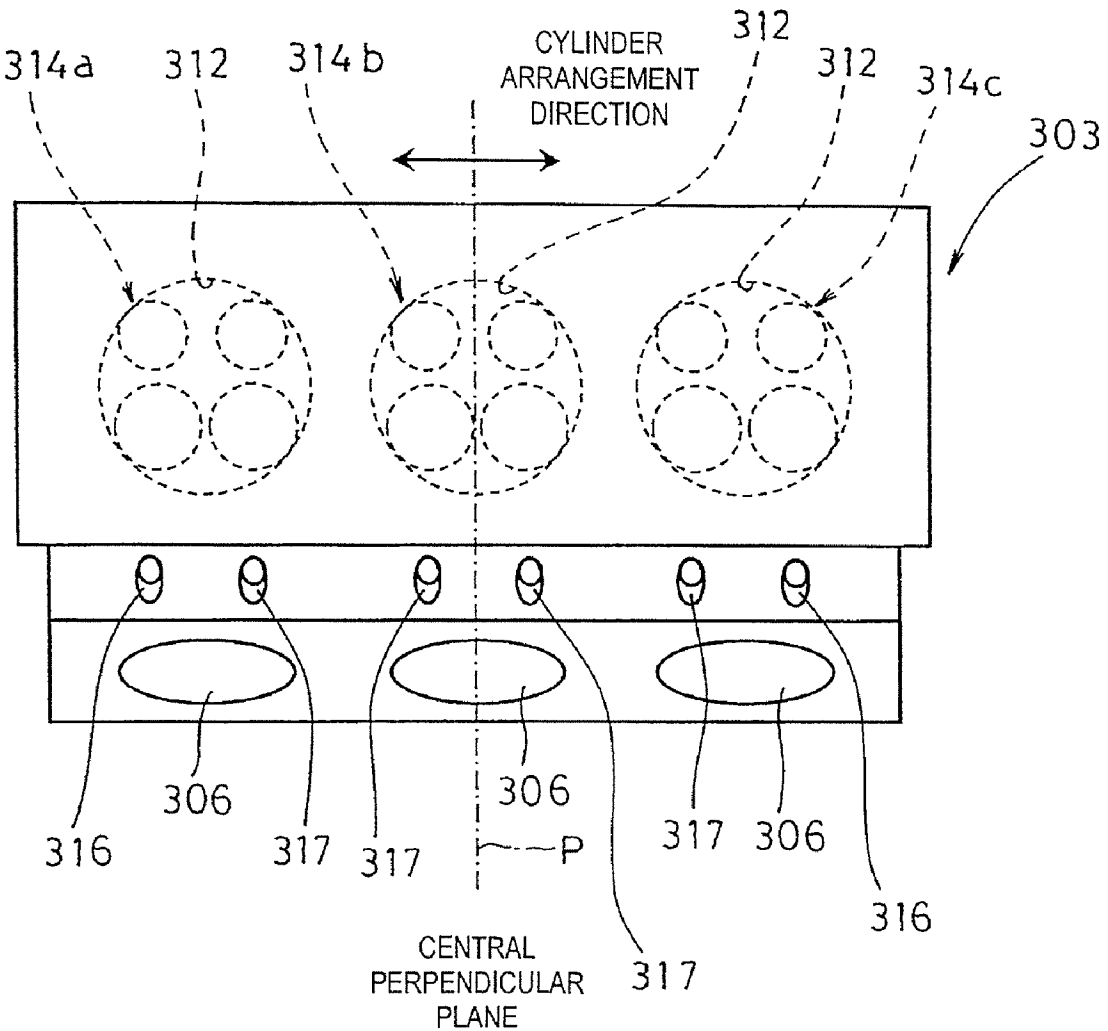
FIG. 13 is an enlarged plan view of a cylinder head illustrating an injector unit mounting structure according to the present invention applied to a three-cylinder engine.

Although the fuel injector assembly for an injector unit 30 is applied to a four-cylinder engine in the embodiment described above, there are no limitations on the number of cylinders, i.e., any number of cylinders is acceptable. FIG. 13 is a top plan view of a cylinder head 303 illustrating a fuel injector assembly applied to a three cylinder engine. As shown in FIG. 13, the cylinder head 303 is configured to accommodate an in-line three cylinder engine having a first cylinder 314*a*, a second cylinder 314*b*, and a third cylinder 314*c* arranged in a straight row (arranged from left to right in FIG. 13). The combustion chambers 312 are arranged in a straight row in positions corresponding to the cylinders 314*a*, 314*b*, and 314*c*. A pair of insertion holes 316 and 317 for inserting injectors is provided in each intake passage 306 of the cylinder head 303, and the insertion holes 316 and 317 are arranged symmetrically with respect to a central perpendicular plane P that is perpendicular to a direction along which the cylinders are arranged in a straight row and arranged to pass through a central position along the row of three combustion chambers 312. An insertion hole 316 is provided on the left and an insertion hole 317 is provided on the right with respect to the first cylinder 314*a*, two insertion holes 317 are provided on the left and right with respect the second cylinder 314*b*, and an insertion hole 317 is provided on the left and an insertion hole 316 is provided on the right with respect to the first cylinder 314*a* (left and right directions are explained from the perspective of FIG. 13). In this embodiment, too, the timing at which the insertion forces of the injectors inserted into the insertion holes 316 reach a peak is different from the timing at which the insertion forces of the injectors inserted into the insertion holes 317 reach a peak. Consequently, the insertion load incurred when attaching the injector unit to the cylinder head 303 can be reduced.

Figure 14:
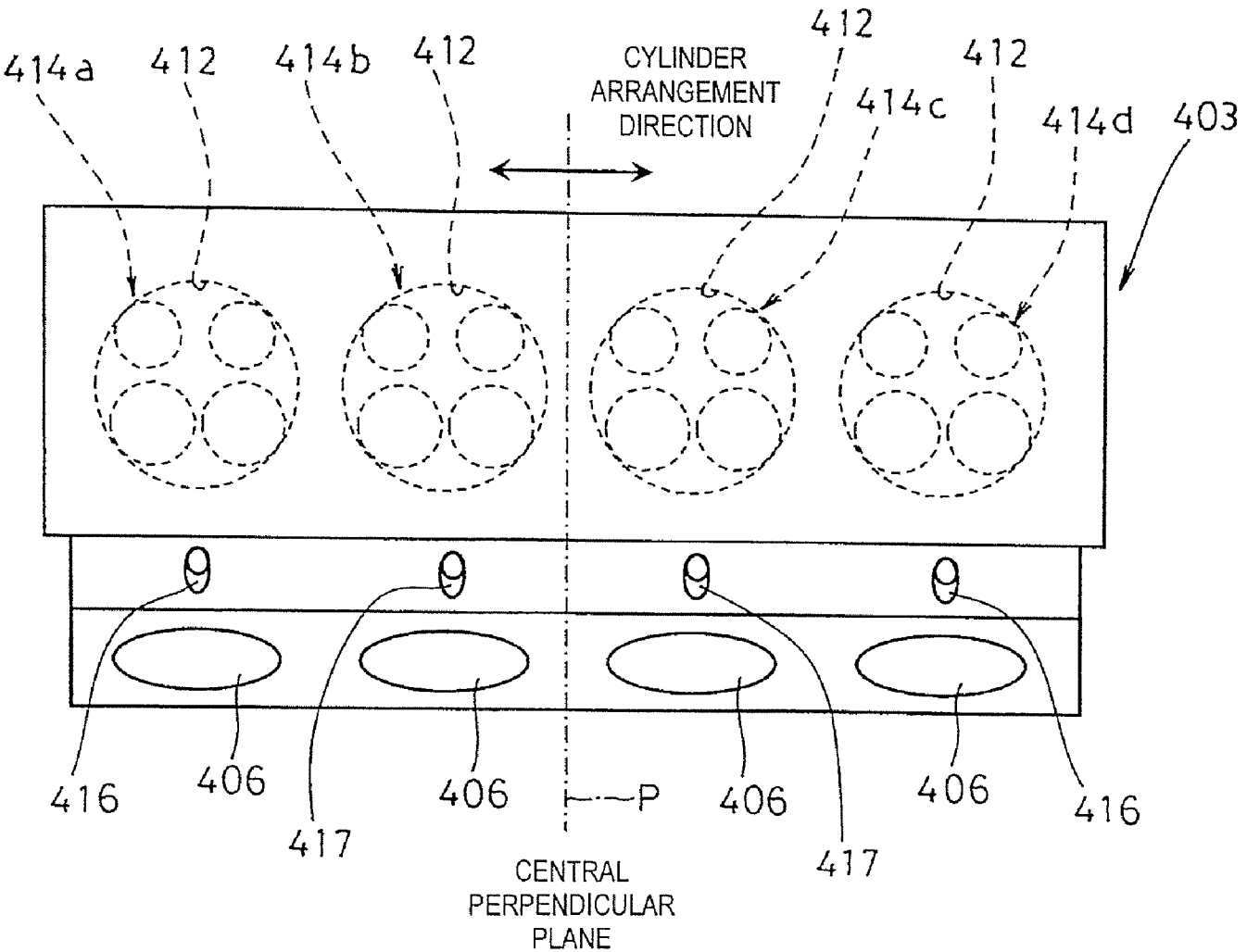
FIG. 14 is an enlarged plan view of a cylinder head according to a variation of the embodiment.
Figure 15:
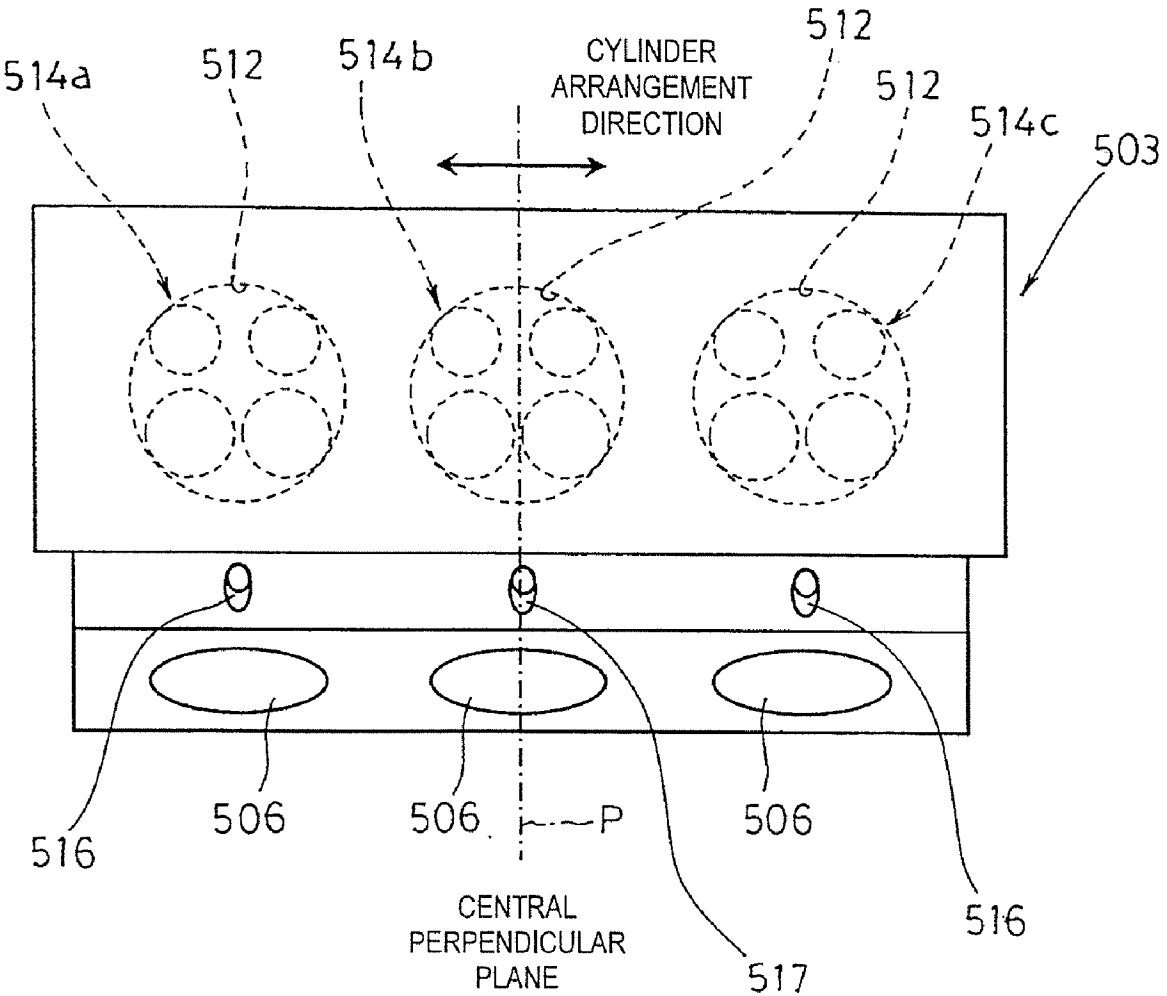
FIG. 15 is an enlarged plan view of a cylinder head for a three-cylinder engine according to a variation of the embodiment.

Although in the embodiment the fuel injector assembly for an injector unit 30 is applied to a twin-injector type engine 1 having a pair of insertion holes 16 and 17 formed in each of the intake passages 6, the present invention can also be applied to a conventional engine having only one insertion hole per intake passage. FIG. 14 is a top plan view of a cylinder head 403 for a conventional in-line four cylinder engine in which one injector is provided in each intake passage, and FIG. 15 is a top plan view of a cylinder head 503 for a conventional in-line three cylinder engine in which one injector is provided in each intake passage. In the cylinder head 403 for an in-line four cylinder engine shown in FIG. 14, each of the intake passages 406 is provided with either an insertion hole 416 or an insertion hole 417 and the insertion holes 416 and 417 are arranged symmetrically with respect to a central perpendicular plane P. Thus, an insertion hole 416 is provided with respect to each of the first cylinder 414*a* and the fourth cylinder 414*d* and an insertion hole 417 is provided with respect to each of the second cylinder 414*b* and the third cylinder 414*c*. In the cylinder head 503 for an in-line three cylinder engine shown in FIG. 15, each of the intake passages 506 is provided with either an insertion hole 516 or an insertion hole 517 and the insertion holes 516 and 517 are arranged symmetrically with respect to a central perpendicular plane P. Thus, an insertion hole 516 is provided with respect to each of the first cylinder 514*a* and the third cylinder 514*c* and an insertion hole 517 is provided with respect the second cylinder 514*b*. It is also acceptable to reverse the arrangement order of the insertion holes 516 and 517.

In the fuel injector assembly for an injector unit 30 according to the embodiment described above, the timing at which the insertion forces of the injectors 8 inserted into the insertion holes 16 reach a peak a is offset from the timing at which the insertion forces of the injectors 8 inserted into the insertion holes 17 reach a peak b by forming the insertion holes 16 and 17 such that the position where the fitting section 16*b* of each of the insertion holes 16 starts is shallower in a depth direction than the position where the fitting section 17*b* of each of the insertion holes 17 starts. However, it is also acceptable to make the start position of the fitting sections 16*b* in the insertion holes 16 the same as the start position of the fitting sections 17*b* in the insertion holes 17 (i.e., make the insertion holes 16 and the insertion holes 17 have exactly the same shape) and, instead, vary the positions where the ring grooves 8*d* for attaching the seal rings 21 are formed on the injectors 8. In this way, too, the timing at which the insertion forces of the injectors 8 inserted into the insertion holes 16 reach a peak a can be offset from the timing at which the insertion forces of the injectors 8 inserted into the insertion holes 17 reach a peak b.

Figure 16:
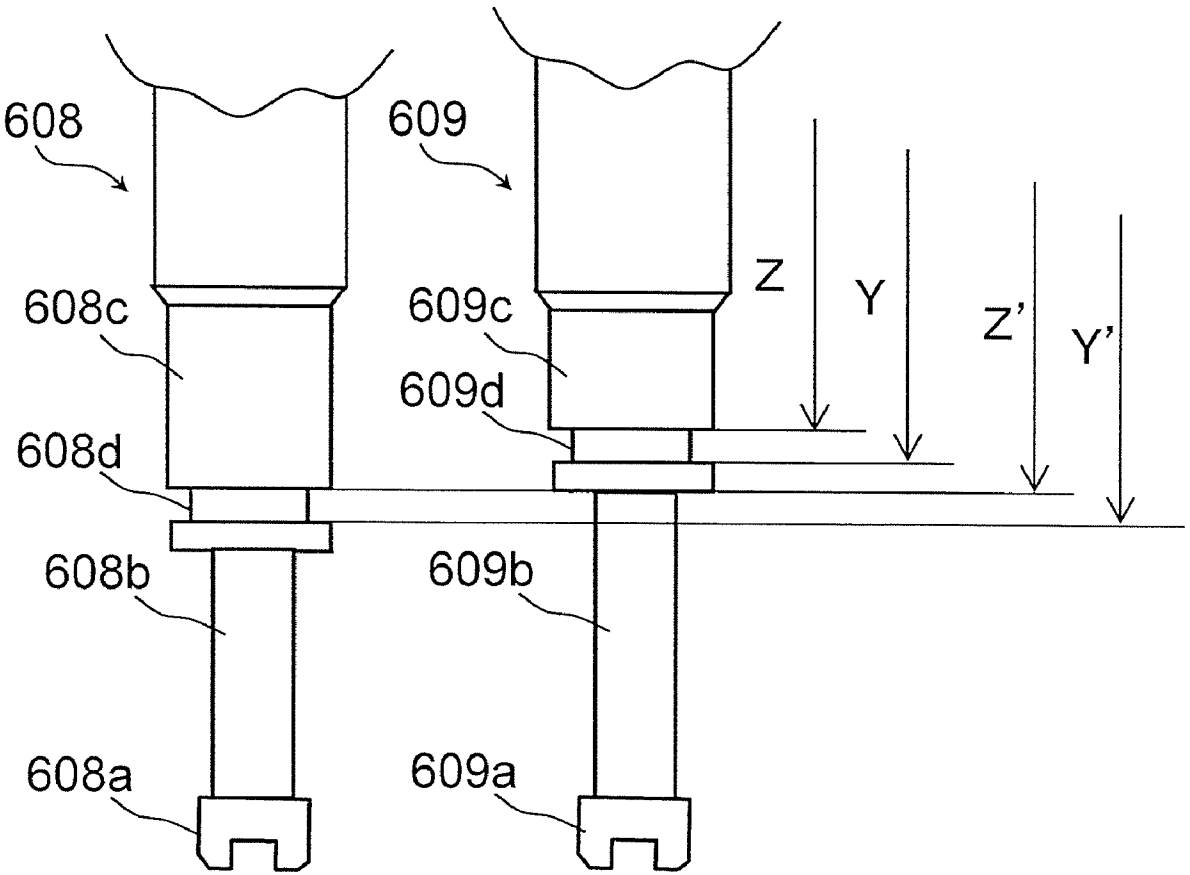
FIG. 16 is a schematic view showing an external appearance of injectors 608 and 609 according to a variation of the embodiment.

FIG. 16 is a schematic view showing an external appearance of injectors 608 and 609 according to a variation of the embodiment. In the figure, the positions where ring grooves 608*d* and 609*d* formed in the injectors 608 and 609 are indicated by the values Y' and Z', and Y and Z. In this variation, the values Y' and Z' for the ring groove 608*d* formed in an injector 608 are larger than the values Y and Z for the ring groove 609*d* formed in an injector 609. The position values Y and Z of the ring grooves 608*d* of the injectors 608 and the position values Y and Z of the ring grooves 609*d* of the injectors 609 are set such that a seal rings 21 arranged on an injector 609 starts to undergo compressive deformation when the injector unit has been pushed toward the cylinder head beyond a point where a seal ring 21 arranged on an injector 608 reached a maximum compressive deformation (i.e., a point where an insertion force required to insert the injector 608 into the insertion hole reached a maximum value) and has reached a point where the insertion force required to insert the injector 608 into the insertion hole has decreased as much as it will.

The injectors 608 and 609 are arranged in the cylinder head in positions symmetrical with respect to a central perpendicular plane that is perpendicular to a direction along which the cylinders are arranged in a straight row and passes through a central position along a row of four combustion chambers. More specifically, the injectors 608 and 609 corresponding to each of a first cylinder and a second cylinder are installed in fuel distribution pipes with the injector 608 on the first cylinder side and the injector 609 on the second cylinder side, and the injectors 608 and 609 corresponding to each of a third cylinder and a fourth cylinder are installed in fuel distribution pipes with the injector 609 on the third cylinder side and the injector 608 on the fourth cylinder side.

With a fuel injector assembly according to this variation, the timing at which the insertion forces of the injectors 608 reach a peak is different from the timing at which the insertion forces of the injectors 609 reach a peak when the injectors 608 and 609 are pushed into the insertion holes. Consequently, the insertion load incurred when attaching the injector unit to the cylinder head can be reduced.

Figure 17:
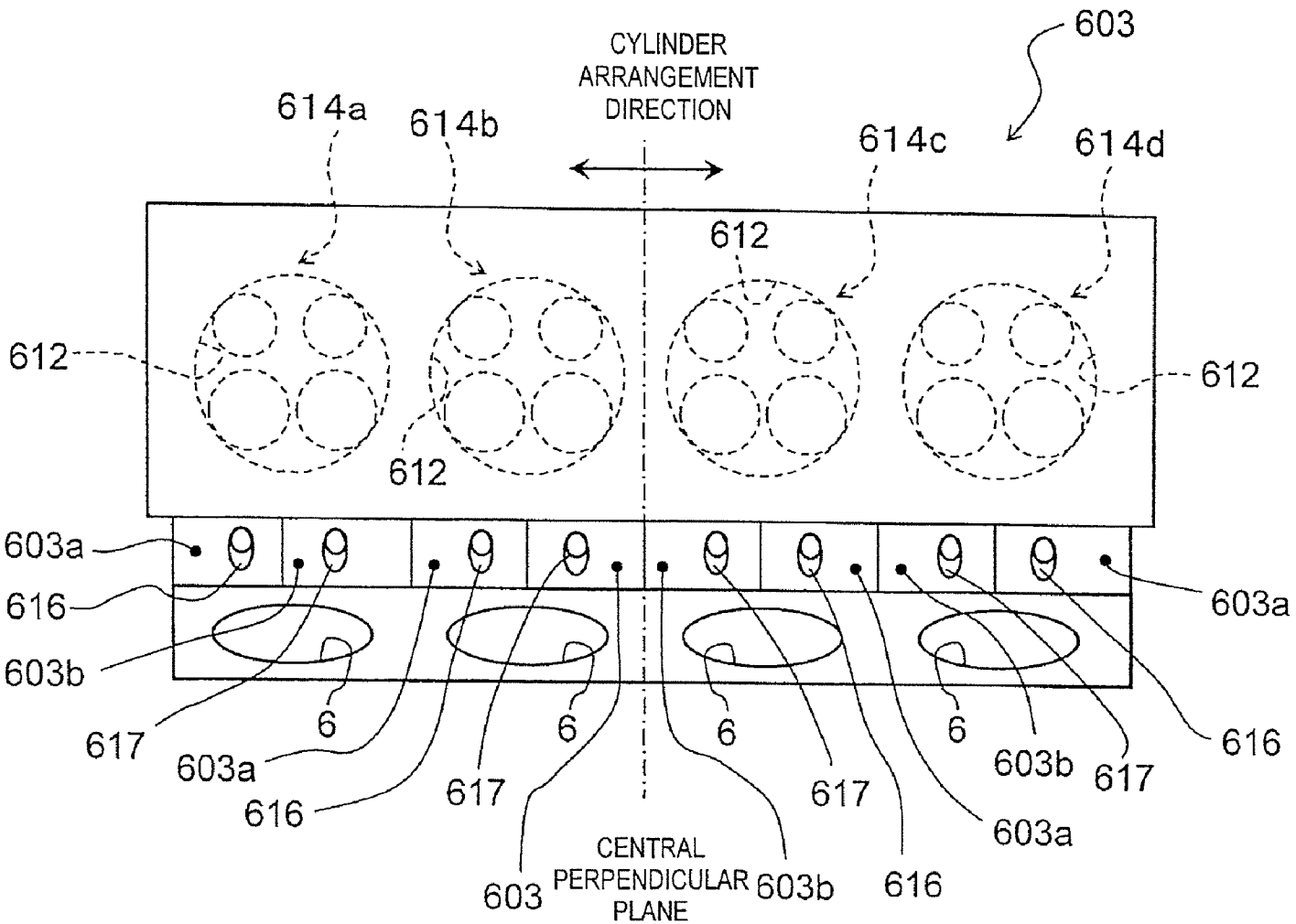
FIG. 17 is an enlarged plan view of a cylinder head 603 of an injector unit mounting structure according to a variation of the embodiment.

In a fuel injector assembly for an injector unit 30 according to the previously described embodiment, the position where the fitting section 16*b* of each of the insertion holes 16 starts is shallower in a depth direction than the position where the fitting section 17*b* of each of the insertion holes 17 starts and, consequently, the timing at which the insertion forces of the injectors 8 inserted into the insertion holes 16 reach a peak a is different from the timing at which the insertion forces of the injectors 8 inserted into the insertion holes 17 reach a peak b. However, it is also acceptable to vary the timings at which the insertion forces of the injectors inserted into the respective insertion holes reach their respective peaks by varying the start positions of the insertion holes as a whole. FIG. 17 is a top plan view of a cylinder head 603 used in a fuel injector assembly according to another variation of the embodiment, and FIG. 18 is an enlarged cross sectional view of an insertion hole formed in the cylinder head 603 for installing an injector.

Figure 18:
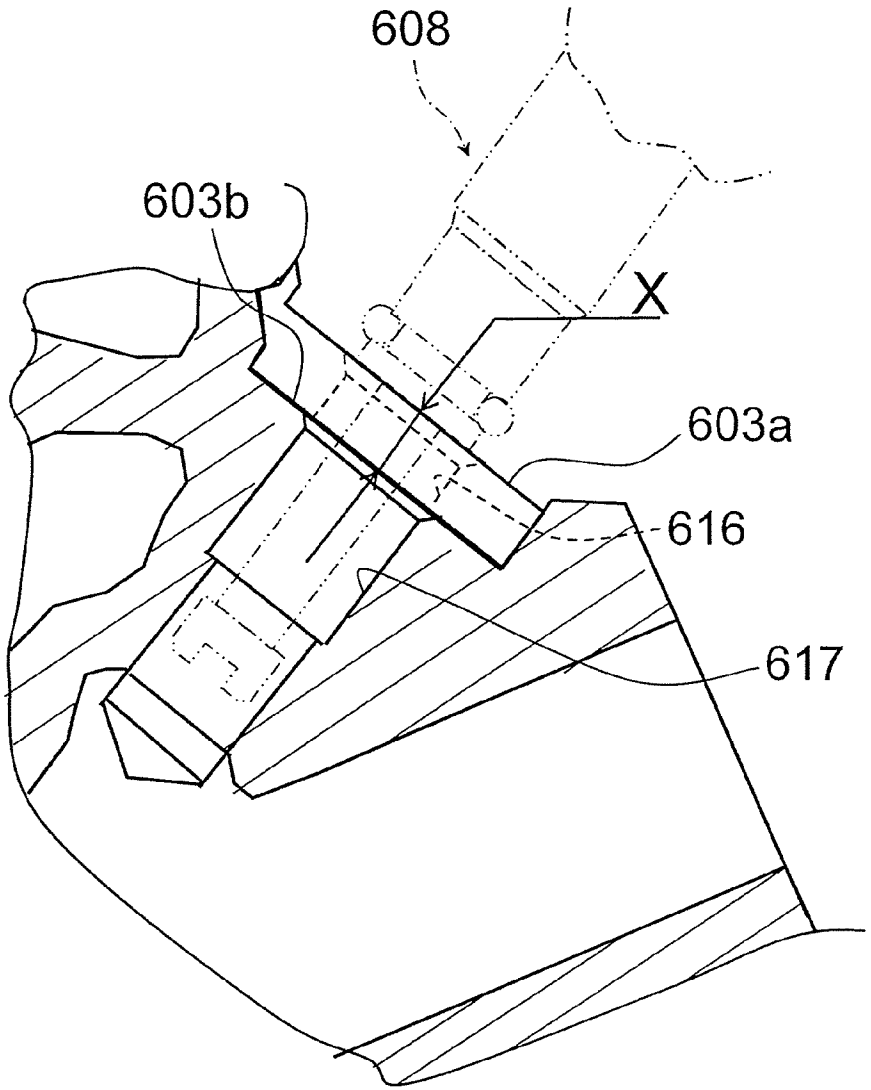
FIG. 18 is an enlarged cross sectional view of an insertion hole formed in the cylinder head 603 for installing an injector.

As shown in FIGS. 17 and 18, the height of a surface 603*a* from which an insertion hole 616 is formed is different from the height of a surface 603*b* from which an insertion hole 617 is formed in the cylinder head 603. More specifically, the height of the surface 603*a* is higher than the height of the surface 603*b* by a height value X. Thus, by merely varying the height positions of the surface 603*a* and 603*b* in which the insertion holes 616 and 617 are formed, the timing at which the insertion forces of the injectors 608 inserted into the insertion holes 616 reach a peak can be offset from the timing at which the insertion forces of the injectors 608 inserted into the insertion holes 617 reach a peak and the insertion load incurred when the injector unit is attached to the cylinder head 603 can be reduced.

In a fuel injector assembly for an injector unit 30 according to the previously described embodiment, each of the eight insertion holes is formed to one of two different depths. However, it is also acceptable for all eight of the insertion holes to have a different depth than the others.

Although in a fuel injector assembly for an injector unit 30 according to the previously described embodiment the insertion holes 16 and 17 are formed in the cylinder head 3, it is also acceptable for the insertion holes to be formed in an intake manifold (not shown) that connects to the intake passages of the cylinder head 3 or in an adapter plate (not shown) fastened between the cylinder head 3 and an intake manifold.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the team, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional team refer to those directions of an internal combustion engine equipped with the fuel injector assembly when the internal combustion engine is oriented as shown in FIG. 1. Accordingly, these terms, as utilized to describe the present invention should be interpreted relative to an internal combustion engine equipped with the fuel injector assembly.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A fuel injector assembly comprising:

a modular fuel injector unit including a first fuel injector with a first seal, a second fuel injector with a second seal and a fuel distribution pipe fluidly communicating with the first and second fuel injectors to distribute a fuel to the first and second fuel injectors, with the first and second fuel injectors and the fuel distribution pipe being coupled together as a single installable unit; and a cylinder head side member including a first insertion hole with a first fitting section that receives the first seal and a second insertion hole with a second fitting section that receives the second seal;

the first and second insertion holes of the cylinder head side member and the first and second seals of the first and second fuel injectors being arranged with respect to each other such that as the modular fuel injector unit is being mounted to the cylinder head side member by inserting the first and second fuel injectors into the first and second insertion holes formed in the cylinder head side member, respectively, the first seal undergoes a maximum compressive deformation in the first fitting section at a time that does not coincide with a time that the second seal undergoes a maximum compressive deformation in the second fitting section.

2. The fuel injector assembly as recited in claim 1, wherein the first and second insertion holes of the cylinder head side member and the first and second seals of the first and second fuel injectors are arranged with respect to each other such that the second seal begins to undergo a compressive deformation in the second fitting section after the first seal has undergone a maximum compressive deformation in the first fitting section as the first and second fuel injectors are inserted into the first and second insertion holes, respectively.

3. The fuel injector assembly as recited in claim 2, wherein the first and second insertion holes of the cylinder head side member and the first and second seals of the first and second fuel injectors are arranged with respect to each other such that the second seal begins to undergo a compressive deformation in the second fitting section after the first and second fuel injectors have been inserted simultaneously into the first and second insertion holes, respectively, by a prescribed stroke amount beyond a position where the first seal reached a maximum compressive deformation in the first fitting section.

4. The fuel injector assembly as recited in claim 3, wherein the first and second insertion holes of the cylinder head side member and the first and second seals of the first and second fuel injectors are arranged with respect to each other such that the prescribed stroke amount is preset to such a value that an insertion load imposed on the first insertion hole by the first fuel injector decreases from a maximum load state in which the insertion load is at a maximum load to a minimum load state in which the insertion load has decreased to a minimum load.

5. The fuel injector assembly as recited in claim 1, wherein the first fitting section is located in the first insertion hole of the cylinder head side member at a position that is shallower along a depth direction of first insertion hole than a position of the second fitting section in the second insertion hole with respect to the depth direction of second insertion hole.

6. The fuel injector assembly as recited in claim 1, wherein the cylinder head side member is part of a cylinder head main body that forms a part of the combustion chamber for a cylinder; and the first and second insertion holes are arranged with respect to the combustion chamber such that fuel is injected from both of the first and second fuel injectors into the same combustion chamber.

7. The fuel injector assembly as recited in claim 6, wherein the modular fuel injector unit further includes at least one of an additional first fuel injector and an additional second fuel injector with the at least one of the additional first fuel injector and the additional second fuel injector fluidly communicating with the fuel distribution pipe, the cylinder head side member further includes at least one of an additional first insertion hole and an additional second insertion hole corresponding to the at least one of the additional first fuel injector and the additional second fuel injector, the cylinder head main body includes a plurality of combustion chambers arranged in a straight row, with the first and second insertion holes and the at least one of the additional first insertion hole and the additional second insertion hole of the cylinder head side member being arranged symmetrically with respect to a central perpendicular plane that is perpendicular to a direction along which the combustion chambers are arranged in the straight row and arranged to pass through a central position along the row of combustion chambers.

8. The fuel injector assembly as recited in claim 1, wherein the cylinder head side member is part of a cylinder head main body that forms parts of a plurality of combustion chambers for cylinders that are arranged in a straight row, and the first and second insertion holes are arranged with respect to the combustion chambers such that fuel injected from the first and second fuel injectors are injected into different combustion chambers, respectively.

9. The fuel injector assembly as recited in claim 8, wherein the modular fuel injector unit further includes at least one of an additional first fuel injector and an additional second fuel injector with the at least one of the additional first fuel injector and the additional second fuel injector fluidly communicating with the fuel distribution pipe, the cylinder head side member further includes at least one of an additional first insertion hole and an additional second insertion hole corresponding to the at least one of the additional first fuel injector and the additional second fuel injector, the first and second insertion holes and the at least one of the additional first insertion hole and the additional second insertion hole of the cylinder head side member are arranged symmetrically with respect to a central perpendicular plane that is perpendicular to a direction along which the combustion chambers are arranged in the straight row and arranged to pass through a central position along the row of combustion chambers.

10. The fuel injector assembly as recited in claim 1, wherein the first seal is attached to the first fuel injector at a first position that is more forward than a position of the second seal of the second fuel injector with respect to an insertion direction in which the first fuel injector is inserted into the first insertion hole and the second fuel injector is inserted into the second insertion hole.

11. A cylinder head side member comprising:

a first fuel injector mounting section including a first insertion hole that is configured to receive a first fuel injector having a first seal; and a second fuel injector mounting section including a second insertion hole that is configured to receive a second fuel injector having a second seal, the first insertion hole being partially defined by a first fitting section configured to receive the first seal of the first fuel injector therein, the second insertion hole being partially defined by a second fitting section configured to receive the second seal of the second fuel injector therein, the first fitting section being located along an axial direction of the first insertion hole at a first axial position and the second fitting section being located along an axial direction of the second insertion hole at a second axial position with the first and second axial positions being arranged such that the first seal undergoes a maximum compressive deformation in the first fitting section at a time that does not coincide with a time that the second seal undergoes a maximum compressive deformation in the second fitting section as the first and second fuel injectors are inserted into the first and second insertion holes, respectively.

12. The cylinder head side member as recited in claim 11, wherein the first and second axial positions are arranged such that the second seal begins to undergo a compressive deformation in the second fitting section after the first seal has undergone a maximum compressive deformation in the first fitting section as the first and second fuel injectors are inserted into the first and second insertion holes, respectively.

13. The cylinder head side member as recited in claim 12, wherein the first and second axial positions are arranged such that the second seal begins to undergo a compressive deformation in the second fitting section after the first and second fuel injectors have been inserted simultaneously into the first and second insertion holes, respectively, by a prescribed stroke amount beyond a position where the first seal reached a maximum compressive deformation in the first fitting section.

14. The cylinder head side member as recited in claim 13, wherein the prescribed stroke amount is set to such a value that an insertion load imposed on the first insertion hole by the first fuel injector decreases from a maximum load state in which the insertion load is at a maximum load to a minimum load state in which the insertion load has decreased to a minimum load.

15. The cylinder head side member as recited in claim 11, wherein the first fitting section is located in the first insertion hole of the cylinder head side member at a position that is shallower along a depth direction of first insertion hole than a position of the second fitting section in the second insertion hole with respect to the depth direction of second insertion hole.

16. The cylinder head side member as recited in claim 11, wherein the first insertion hole is partially defined by a first tapered section that is formed at a rearward end of the first fitting section of the first insertion hole with respect to an insertion direction in which the first fuel injector is inserted into the first insertion hole with the first tapered section gradually increasing in diameter in a rearward direction towards an entrance opening of the first insertion hole, and the second insertion hole is partially defined by a second tapered section that is formed at a rearward end of the second fitting section of the second insertion hole with respect to an insertion direction in which the second fuel injector is inserted into the second insertion hole with the second tapered section gradually increasing in diameter in a rearward direction towards an entrance opening of the second insertion hole.

17. A fuel injector installation method comprising:

providing a modular fuel injector unit including a first fuel injector with a first seal, a second fuel injector with a second seal and a fuel distribution pipe fluidly communicating with the first and second fuel injectors to distribute a fuel to the first and second fuel injectors, with the first and second fuel injectors and the fuel distribution pipe being coupled together as a single installable unit;

inserting the first and second fuel injectors into first and second insertion holes of the cylinder head side member, respectively, such that a first seal of the first fuel injector undergoes a maximum compressive deformation in a first fitting section of the first insertion hole at a time that does not coincide with a time when a second seal of the second fuel injector undergoes a maximum compressive deformation in a second fitting section of the second insertion hole.

* * * * *